US008138915B2

(12) United States Patent
Milbar

(10) Patent No.: US 8,138,915 B2
(45) Date of Patent: Mar. 20, 2012

(54) SYSTEMS AND METHODS FOR RENDERING ALERT INFORMATION FOR DIGITAL RADIO BROADCAST, AND ACTIVE DIGITAL RADIO BROADCAST RECEIVER

(75) Inventor: Marek Milbar, Huntingdon Valley, PA (US)

(73) Assignee: iBiquity Digital Corporation, Columbia, MD (US)

( * ) Notice: Subject to any disclaimer, the term of this patent is extended or adjusted under 35 U.S.C. 154(b) by 318 days.

(21) Appl. No.: 11/984,290

(22) Filed: Nov. 15, 2007

(65) Prior Publication Data

US 2009/0128323 A1 May 21, 2009

(51) Int. Cl.
*G08B 1/08* (2006.01)

(52) U.S. Cl. ..... 340/539.14; 340/539.1; 340/539.3; 340/539.21; 340/539.26; 340/539.28; 379/37; 455/404.1

(58) Field of Classification Search .. 340/539.1–539.26, 340/573.1, 870.16; 379/37–39; 455/404.1, 455/411, 404.2
See application file for complete search history.

(56) References Cited

U.S. PATENT DOCUMENTS

| | | | | |
|---|---|---|---|---|
| 6,177,873 | B1 * | 1/2001 | Cragun | 340/601 |
| 6,397,076 | B1 * | 5/2002 | Brown et al. | 455/521 |
| 6,553,215 | B1 | 4/2003 | Chung | 455/218 |
| 2003/0084108 | A1 | 5/2003 | Syed | 709/206 |
| 2005/0136884 | A1 * | 6/2005 | Reidelsturz et al. | 455/403 |
| 2005/0174233 | A1 | 8/2005 | Kennedy et al. | |
| 2006/0135115 | A1 | 6/2006 | Bell | 455/404.1 |
| 2006/0161946 | A1 | 7/2006 | Shin | 725/33 |
| 2006/0184962 | A1 | 8/2006 | Kendall et al. | 725/33 |
| 2006/0209941 | A1 | 9/2006 | Kroeger | 375/222 |
| 2006/0223492 | A1 | 10/2006 | Chin et al. | 455/404.1 |
| 2006/0267783 | A1 | 11/2006 | Smith | 340/601 |
| 2006/0271952 | A1 | 11/2006 | Gurley et al. | 725/33 |
| 2006/0273893 | A1 | 12/2006 | Warner | 340/531 |
| 2006/0273895 | A1 | 12/2006 | Kollin | 340/539.17 |
| 2006/0292980 | A1 | 12/2006 | Marcos Alba | |
| 2007/0008104 | A1 | 1/2007 | McBain | 340/517 |
| 2007/0021099 | A1 * | 1/2007 | Sato | 455/404.1 |
| 2007/0030156 | A1 | 2/2007 | Schlager et al. | 340/573.1 |
| 2007/0047520 | A1 | 3/2007 | Byers et al. | 370/352 |
| 2007/0052533 | A1 | 3/2007 | Glazer | 340/539.11 |
| 2007/0252688 | A1 * | 11/2007 | Eisold et al. | 340/506 |

OTHER PUBLICATIONS

International Search Report dated Jan. 28, 2009 from corresponding International Application No. PCT/US2008/012752.

Written Opinion of the International Searching Authority dated Jan. 28, 2009 from corresponding International Application No. PCT/US2008/012752.

OASIS Emergency Management Technical Committee, "OASIS Common Alterting Protocol, v. 1.1," OASIS Standard CAP-V1.1, Oct. 1, 2005, pp. 1-35, http://www.oasis-open.org/apps/org/workgroup/emergency/download.php/14205/emergency-CAPv1.1-Committee%20Specification.doc.

National Radio Systems Committee, "NRSC-5-A: In-Band On-Channel Digital Radio Broadcasting Standard," Sep. 2005, pp. 1-36, http://www.nrscstandards.org/SG/NRSC-5-A/NRSC-5-A.pdf.

* cited by examiner

*Primary Examiner* — Brent Swarthout
(74) *Attorney, Agent, or Firm* — Jones Day

(57) ABSTRACT

A method for rendering an alert message on a digital radio broadcast receiver is described. A digital radio broadcast signal is received at the digital radio broadcast receiver. Data corresponding to an alert message comprising type information for identifying a type of the alert message and message information is detected. If the type information satisfies a triggering condition for a type of alert message pre-selected by a user of the digital radio broadcast receiver, the message information is rendered at the digital radio broadcast receiver. A digital radio broadcast receiver that performs the method is also described.

22 Claims, 18 Drawing Sheets

| Code | Type Value | Comments |
|---|---|---|
| 000000 | None | No Valid Indication Provided |
| 000001 | Other | Valid but Non-specific |
| 000010 | Geo | Geophysical |
| 000011 | Met | Meteorological |
| 000100 | Safety | General Public Safety |
| 000101 | Security | DHS, Law Enforcement etc. |
| 000110 | Rescue | Such as Amber – Child Rescue |
| 000111 | Fire | |
| 001000 | Health | |
| 001001 | Env | Pollution or Other Environmental Related |
| 001010 | Transport | Transportation Related |
| 001011 | Infra | Non-transportation Infrastructure (Utility, Telecom, etc.) |
| 001100 | CBRNE | Chemical, Biological Threat or Attack, etc. |
| 001101 | Commercial 1 | |
| 001110 | Commercial 2 | |
| 001111 | Commercial 3 | |
| 010000-111111 | Reserved | Future Use |

FIG. 10

| Code | Message Kind Value |
|---|---|
| 000 | Reserved (Default) |
| 001 | Alert |
| 010 | Update |
| 011 | Cancel |
| 100-111 | Reserved |

TABLE 2

| Code | Status Value |
|---|---|
| 000 | Reserved (Default) |
| 001 | Actual |
| 010 | Exercise |
| 011 | System |
| 100 | Test |
| 101-111 | Reserved |

TABLE 1

| Code | Scope Value |
|---|---|
| 000 | Reserved (Default) |
| 001 | Public |
| 010 | Restricted |
| 011 | Private |
| 100-111 | Reserved |

TABLE 3

FIG. 11

| Code | NoL Value |
|---|---|
| 00 | None (Default) |
| 01 | 1 Location |
| 10 | 2 Locations |
| 11 | 3 Locations |

TABLE 2

| Code | FMT Value |
|---|---|
| 00 | SAME |
| 01 | FIPS |
| 10 | ZIP |
| 11 | Reserved |

TABLE 1

FIG. 12

SYSTEMS AND METHODS FOR RENDERING ALERT INFORMATION FOR DIGITAL RADIO BROADCAST, AND ACTIVE DIGITAL RADIO BROADCAST RECEIVER

FIELD OF THE DISCLOSURE

This disclosure relates to digital radio broadcasting receivers, and more particularly to systems and methods for rendering alert information on a digital radio broadcast receiver.

BACKGROUND INFORMATION

Emergency alert notification systems for conventional analog AM and FM radios are typically generated by a public authority and targeted to the listening public. The mechanism for providing emergency alert notification via conventional analog AM and FM radios are generally limited to providing warning tones and/or broadcast announcements to a radio listener.

In contrast, digital radio broadcasting technology delivers digital audio and data services to mobile, portable, and fixed receivers. One type of digital radio broadcasting, referred to as in-band on-channel (IBOC) digital audio broadcasting (DAB), uses terrestrial transmitters in the existing Medium Frequency (MF) and Very High Frequency (VHF) radio bands. HD Radio™ technology, developed by iBiquity Digital Corporation, is one example of an IBOC implementation for digital radio broadcasting and reception.

IBOC DAB signals can be transmitted in a hybrid format including an analog modulated carrier in combination with a plurality of digitally modulated carriers or in an all-digital format wherein the analog modulated carrier is not used. Using the hybrid mode, broadcasters may continue to transmit analog AM and FM simultaneously with higher-quality and more robust digital signals, allowing themselves and their listeners to convert from analog-to-digital radio while maintaining their current frequency allocations.

One feature of digital transmission systems is the inherent ability to simultaneously transmit both digitized audio and data. Thus the technology also allows for wireless data services from AM and FM radio stations. The broadcast signals can include metadata, such as the artist, song title, or station call letters.

IBOC DAB technology can provide digital quality audio, superior to existing analog broadcasting formats. Because each IBOC DAB signal is transmitted within the spectral mask of an existing AM or FM channel allocation, it requires no new spectral allocations. IBOC DAB promotes economy of spectrum while enabling broadcasters to supply digital quality audio to the present base of listeners.

Multicasting, the ability to deliver several programs or data streams over one channel in the AM or FM spectrum, enables stations to broadcast multiple streams of data on separate supplemental or sub-channels of the main frequency. For example, multiple streams of data can include alternative music formats, local traffic, weather, news, and sports. The supplemental channels can be accessed in the same manner as the traditional station frequency using tuning or seeking functions. For example, if the analog modulated signal is centered at 94.1 MHz, the same broadcast in IBOC DAB can include supplemental channels 94.1-1, 94.1-2, and 94.1-3. Highly specialized programming on supplemental channels can be delivered to tightly targeted audiences, creating more opportunities for advertisers to integrate their brand with program content. As used herein, multicasting includes the transmission of one or more programs in a single digital radio broadcasting channel or on a single digital radio broadcasting signal. Multicast content can include a main program service (MPS), supplemental program services (SPS), program service data (PSD), and/or other broadcast data.

The National Radio Systems Committee, a standard-setting organization sponsored by the National Association of Broadcasters and the Consumer Electronics Association, adopted an IBOC standard, designated NRSC-5A, in September 2005. NRSC-5A, the disclosure of which is incorporated herein by reference, sets forth the requirements for broadcasting digital audio and ancillary data over AM and FM broadcast channels. The standard and its reference documents contain detailed explanations of the RF/transmission subsystem and the transport and service multiplex subsystems. Copies of the standard can be obtained from the NRSC at http://www.nrscstandards.org/standards.asp. iBiquity's HD Radio™ technology is an implementation of the NRSC-5A IBOC standard. Further information regarding HD Radio™ technology can be found at www.hdradio.com and www.ibiquity.com.

Other types of digital radio broadcasting systems include satellite systems such as XM® Radio, Sirius®, and WorldSpace®, and terrestrial systems such as Digital Radio Mondiale™ (DRM), Eureka™ 147 (branded as DAB), DAB™ Version 2, and FMeXtra®. As used herein, the phrase "digital radio broadcasting" encompasses digital audio broadcasting including in-band on-channel broadcasting, as well as other digital terrestrial broadcasting and satellite broadcasting.

Digital radio broadcasting systems are also capable of broadcasting traditional emergency alerts. However, the present inventor has observed that it would be desirable to take advantage of the enhanced capabilities of digital radio broadcast systems by transmitting and rendering at a receiver an enhanced breadth of alert information.

SUMMARY

It is an object of the present invention to provide an enhanced breadth of alert information to a digital radio broadcast receiver. The alert information may be supported by any AM or FM digital broadcasting station and any suitable digital radio broadcasting receiver, as discussed herein.

According to an exemplary embodiment, a method for rendering an alert message on a digital radio broadcast receiver is provided. The method comprises receiving a digital radio broadcast signal at the digital radio broadcast receiver. The method also comprises detecting data corresponding to an alert message within the digital radio broadcast signal, wherein the data corresponding to the alert message comprises type information for identifying a type of the alert message and message information. The method also comprises determining whether the type information satisfies a triggering condition for a type of alert message pre-selected by a user of the digital radio broadcast receiver, and if the type information satisfies the triggering condition, rendering the message information of the alert message at the digital radio broadcast receiver.

According to another exemplary embodiment, a digital radio broadcast receiver for rendering an alert message is provided. The digital radio broadcast receiver comprises a tuner, a processing system, and a user interface. The user interface comprises an input system for allowing said user to select which of multiple types of alert message are to be rendered. The processing system configured to detect data corresponding to an alert message within said digital radio broadcast signal, said data comprising type information for identifying a type of said alert message and message information, determine whether said type information satisfies a triggering condition for a type of alert message pre-selected by a user of the digital radio broadcast receiver, and if said triggering condition is satisfied, cause said message information of said alert message to be rendered at said digital radio broadcast receiver.

According to another exemplary embodiment, an article of manufacture comprising a computer usable medium having computer readable program code embodied therein for rendering an alert message on a digital radio broadcast receiver is provided. The computer readable program code is adapted to cause a processing system of said digital radio broadcast receiver to detect data corresponding to an alert message within a digital radio broadcast signal, said data comprising type information for identifying a type of said alert message and message information, determine whether said type information satisfies a triggering condition for a type of alert message pre-selected by a user of the digital radio broadcast receiver; and if said triggering condition is satisfied, cause said message information of said alert message to be rendered at said digital radio broadcast receiver. The computer readable medium can comprise any suitable memory or memory device that can store computer instructions, including, for example, but not limited to, a magnetic disk, optical disc such as a compact disk or DVD, flash memory, memory card, RAM, ROM, or any other suitable memory.

In some exemplary embodiments, the method comprises controlling the digital radio broadcast receiver to maintain a power condition in which a clock function is powered on and in which tuner functions and rendering functions, and, optionally some or all signal processing functions, are powered off and controlling the digital radio broadcast receiver to periodically power on the tuner functions, and optionally power on some or all signal processing functions, to receive the digital radio broadcast signal. If the data corresponding to the alert message is detected and satisfies conditions selected by the user, the rendering functions of the digital radio broadcast receiver is powered on to render the message information.

In some exemplary embodiments, the message information includes audio information to be rendered (e.g., presented to the user audibly) at the digital radio broadcast receiver. In some exemplary embodiments, the message information includes visual information to be rendered (e.g., displayed) at the digital radio broadcast receiver. In some exemplary embodiments, both audio information and visual information of the message information can be rendered at the digital radio broadcast receiver.

In some exemplary embodiments, the processing system is adapted to control an external device in response to the received alert message.

In some exemplary embodiments, the alert message comprises data corresponding to an emergency alert that may be selected from a group consisting of a security alert, an Amber alert, an extreme weather alert, a traffic alert, and an environmental alert.

In some exemplary embodiments, the alert message comprises information regarding time-sensitive commercial product availability or time-sensitive commercial service availability.

In some exemplary embodiments, the alert message comprises a first portion comprising primary alert information to be rendered by the digital radio broadcast receiver and a second portion comprising secondary information that can be ignored if the digital radio broadcast receiver does not possess functionality to render the secondary information.

BRIEF DESCRIPTION OF THE DRAWINGS

FIG. 10 shows a table illustrating an exemplary list of codes for specifying category type for an alert message as an example of type information.

FIG. 11 shows three tables illustrating exemplary lists of codes for various fields for an alert message.

FIG. 12 shows two tables illustrating exemplary lists of codes for fields associated with location information for an alert message.

DETAILED DESCRIPTION OF EXEMPLARY EMBODIMENTS

FIGS. 1-8 and the accompanying description herein provide a general description of an IBOC system, including broadcasting equipment structure and operation, receiver structure and operation including functionality related to generating, transmitting, receiving and rendering alert information, and the structure of IBOC DAB waveforms. FIGS. 9-17 and the accompanying description herein provide further description of a user interface in accordance with an exemplary embodiment, operational flow charts of a digital radio broadcast receiver configured to render alert information in accordance with exemplary embodiments, and exemplary representations of data structures containing alert information.

Figure 1:
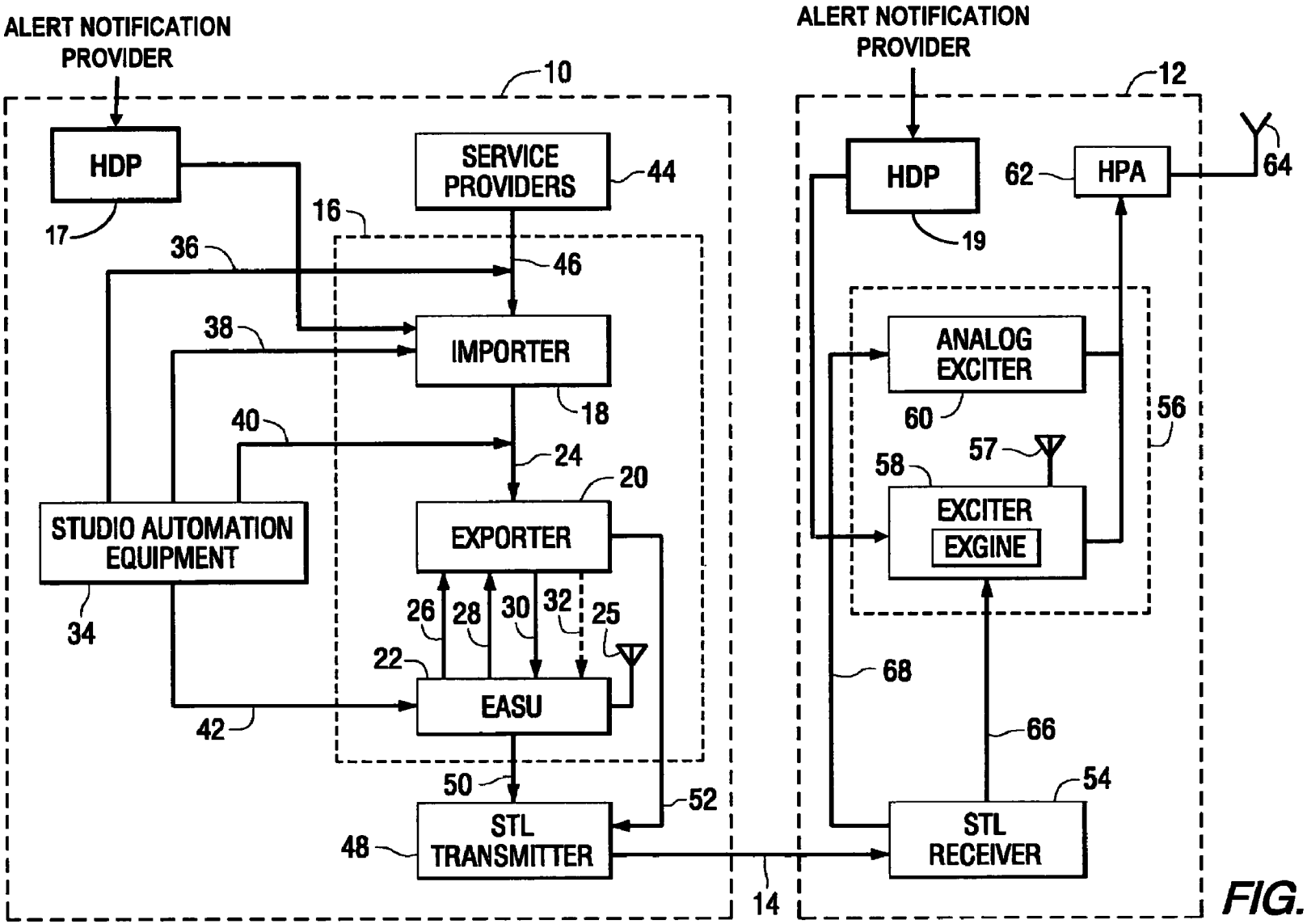
FIG. 1 is a block diagram of an exemplary studio site and transmitter site for use in an IBOC digital radio broadcasting system.

Referring to the drawings, FIG. 1 is a functional block diagram of the relevant components of a studio site 10, an FM transmitter site 12, and a studio transmitter link (STL) 14 that can be used to broadcast an FM IBOC DAB signal. The studio site 10 includes, among other things, studio automation equipment 34, an Ensemble Operations Center (EOC) 16 that includes an importer 18, an exporter 20, an exciter auxiliary service unit (EASU) 22, and an STL transmitter 48. The transmitter site includes an STL receiver 54, a digital exciter 56 that includes an exciter engine (engine) subsystem 58, and an analog exciter 60. While in FIG. 1 the exporter is resident at a radio station's studio site and the exciter is located at the transmission site, these elements may be co-located at the transmission site.

At the studio site 10, the studio automation equipment supplies main program service (MPS) audio 42 to the EASU, MPS data 40 to the exporter, supplemental program service (SPS) audio 38 to the importer, and SPS data 36 to the importer. MPS audio serves as the main audio programming source. In hybrid modes, it preserves the existing analog radio programming formats in both the analog and digital transmissions. MPS data, also known as program service data (PSD), includes information such as music title, artist, album name, etc. Supplemental program service can include supplementary audio content as well as program associated data. Main program service data may be referred to herein as MPSD, and supplemental program service data may be referred to herein as SPSD.

The importer contains hardware and software for supplying advanced application services (AAS). A "service" is content that is delivered to users via an IBOC DAB broadcast, and AAS can include any type of data that is not classified as MPS, SPS, or Station Information Service (SIS). SIS provides station information, such as call sign, absolute time, position correlated to GPS, etc. Examples of AAS data include real-time traffic and weather information, navigation map updates or other images, electronic program guides, multimedia programming, other audio services, and other content. The content for AAS can be supplied by service providers 44, which provide service data 46 to the importer via an application program interface (API). The service providers may be a broadcaster located at the studio site or externally sourced third-party providers of services and content. The importer can establish session connections between multiple service providers. The importer encodes and multiplexes service data 46, SPS audio 38, SPS data 36, and alert information to produce exporter link data 24, which is output to the exporter via a data link.

The exporter 20 contains the hardware and software necessary to supply the main program service and SIS for broadcasting. The exporter accepts digital MPS audio 26 over an audio interface and compresses the audio. The exporter also multiplexes MPS data 40, exporter link data 24, and the compressed digital MPS audio to produce exciter link data 52. In addition, the exporter accepts analog MPS audio 28 over its audio interface and applies a pre-programmed delay to it to produce a delayed analog MPS audio signal 30. This analog audio can be broadcast as a backup channel for hybrid IBOC DAB broadcasts. The delay compensates for the system delay of the digital MPS audio, allowing receivers to blend between the digital and analog program without a shift in time. In an AM transmission system, the delayed MPS audio signal 30 is converted by the exporter to a mono signal and sent directly to the STL as part of the exciter link data 52.

The EASU 22 accepts MPS audio 42 from the studio automation equipment, rate converts it to the proper system clock, and outputs two copies of the signal, one digital (26) and one analog (28). The EASU includes a GPS receiver that is connected to an antenna 25. The GPS receiver allows the EASU to derive a master clock signal, which is synchronized to the exciter's clock by use of GPS units. The EASU provides the master system clock used by the exporter. The EASU is also used to bypass (or redirect) the analog MPS audio from being passed through the exporter in the event the exporter has a catastrophic fault and is no longer operational. The bypassed audio 32 can be fed directly into the STL transmitter, eliminating a dead-air event.

STL transmitter 48 receives delayed analog MPS audio 50 and exciter link data 52. It outputs exciter link data and delayed analog MPS audio over STL link 14, which may be either unidirectional or bidirectional. The STL link may be a digital microwave or Ethernet link, for example, and may use the standard User Datagram Protocol or the standard TCP/IP.

The transmitter site includes an STL receiver 54, an exciter 56 and an analog exciter 60. The STL receiver 54 receives exciter link data, including audio and data signals as well as command and control messages, over the STL link 14. The exciter link data is passed to the exciter 56, which produces the IBOC DAB waveform. The exciter includes a host processor, digital up-converter, RF up-converter, and exgine subsystem 58. The exgine accepts exciter link data and modulates the digital portion of the IBOC DAB waveform. The digital up-converter of exciter 56 converts from digital-to-analog the baseband portion of the exgine output. The digital-to-analog conversion is based on a GPS clock, common to that of the exporter's GPS-based clock derived from the EASU. Thus, the exciter 56 includes a GPS unit and antenna 57. An alternative method for synchronizing the exporter and exciter clocks can be found in U.S. patent application Ser. No. 11/081,267 (Publication No. 2006/0209941 A1), the disclosure of which is hereby incorporated by reference. The RF up-converter of the exciter up-converts the analog signal to the proper in-band channel frequency. The up-converted signal is then passed to the high power amplifier 62 and antenna 64 for broadcast. In an AM transmission system, the exgine subsystem coherently adds the backup analog MPS audio to the digital waveform in the hybrid mode; thus, the AM transmission system does not include the analog exciter 60. In addition, the exciter 56 produces phase and magnitude information and the analog signal is output directly to the high power amplifier.

IBOC DAB signals can be transmitted in both AM and FM radio bands, using a variety of waveforms. The waveforms include an FM hybrid IBOC DAB waveform, an FM all-digital IBOC DAB waveform, an AM hybrid IBOC DAB waveform, and an AM all-digital IBOC DAB waveform.

Figure 2:
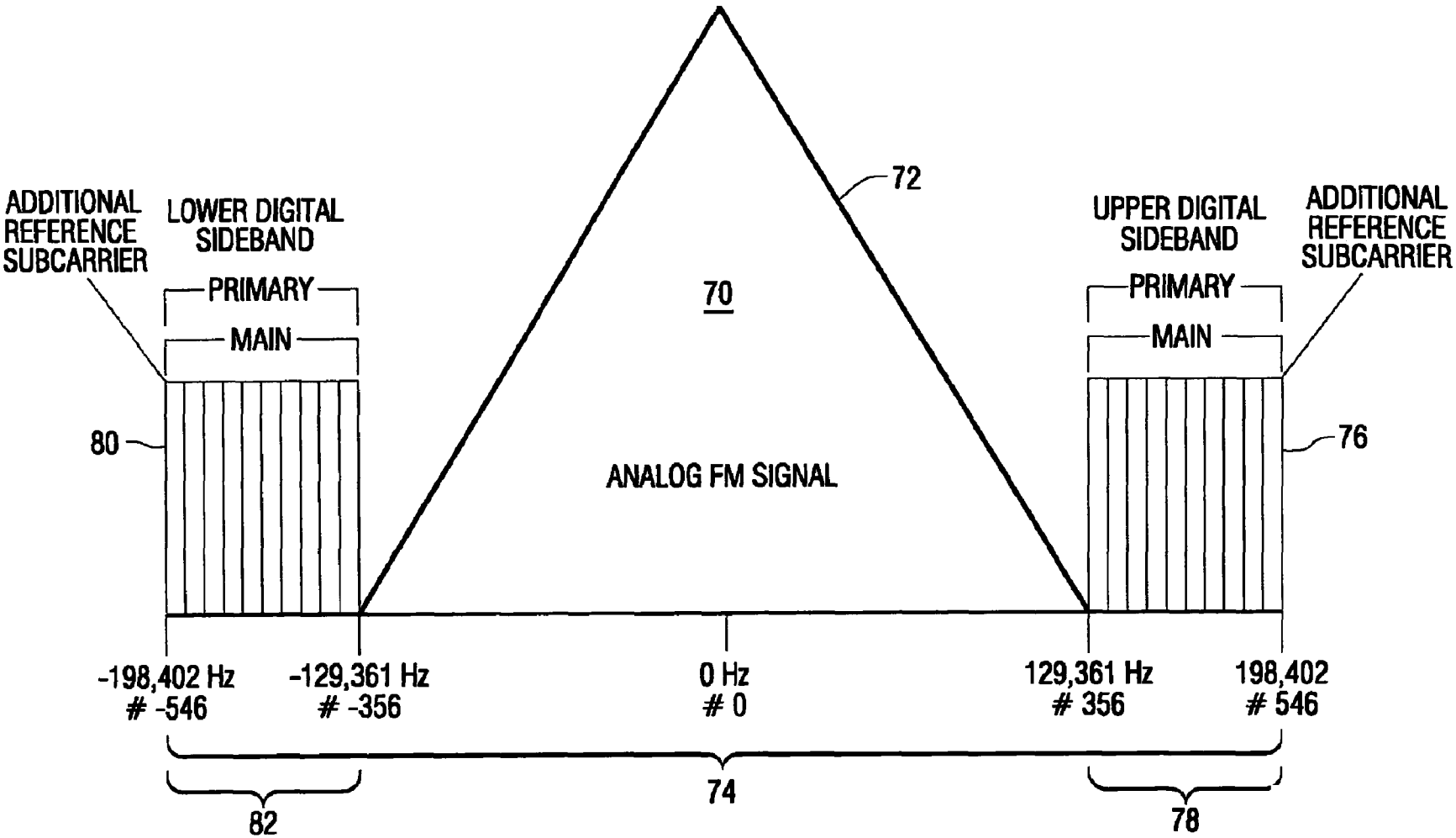
FIG. 2 is a schematic representation of an exemplary hybrid FM IBOC waveform.

FIG. 2 is a schematic representation of a hybrid FM IBOC waveform 70. The waveform includes an analog modulated signal 72 located in the center of a broadcast channel 74, a first plurality of evenly spaced orthogonally frequency division multiplexed subcarriers 76 in an upper sideband 78, and a second plurality of evenly spaced orthogonally frequency division multiplexed subcarriers 80 in a lower sideband 82. The digitally modulated subcarriers are divided into partitions and various subcarriers are designated as reference subcarriers. A frequency partition is a group of 19 OFDM subcarriers containing 18 data subcarriers and one reference subcarrier.

The hybrid waveform includes an analog FM-modulated signal, plus digitally modulated primary main subcarriers. The subcarriers are located at evenly spaced frequency locations. The subcarrier locations are numbered from −546 to +546. In the waveform of FIG. 2, the subcarriers are at locations +356 to +546 and −356 to −546. Each primary main sideband is comprised of ten frequency partitions. Subcarriers 546 and −546, also included in the primary main sidebands, are additional reference subcarriers. The amplitude of each subcarrier can be scaled by an amplitude scale factor.

Figure 3:
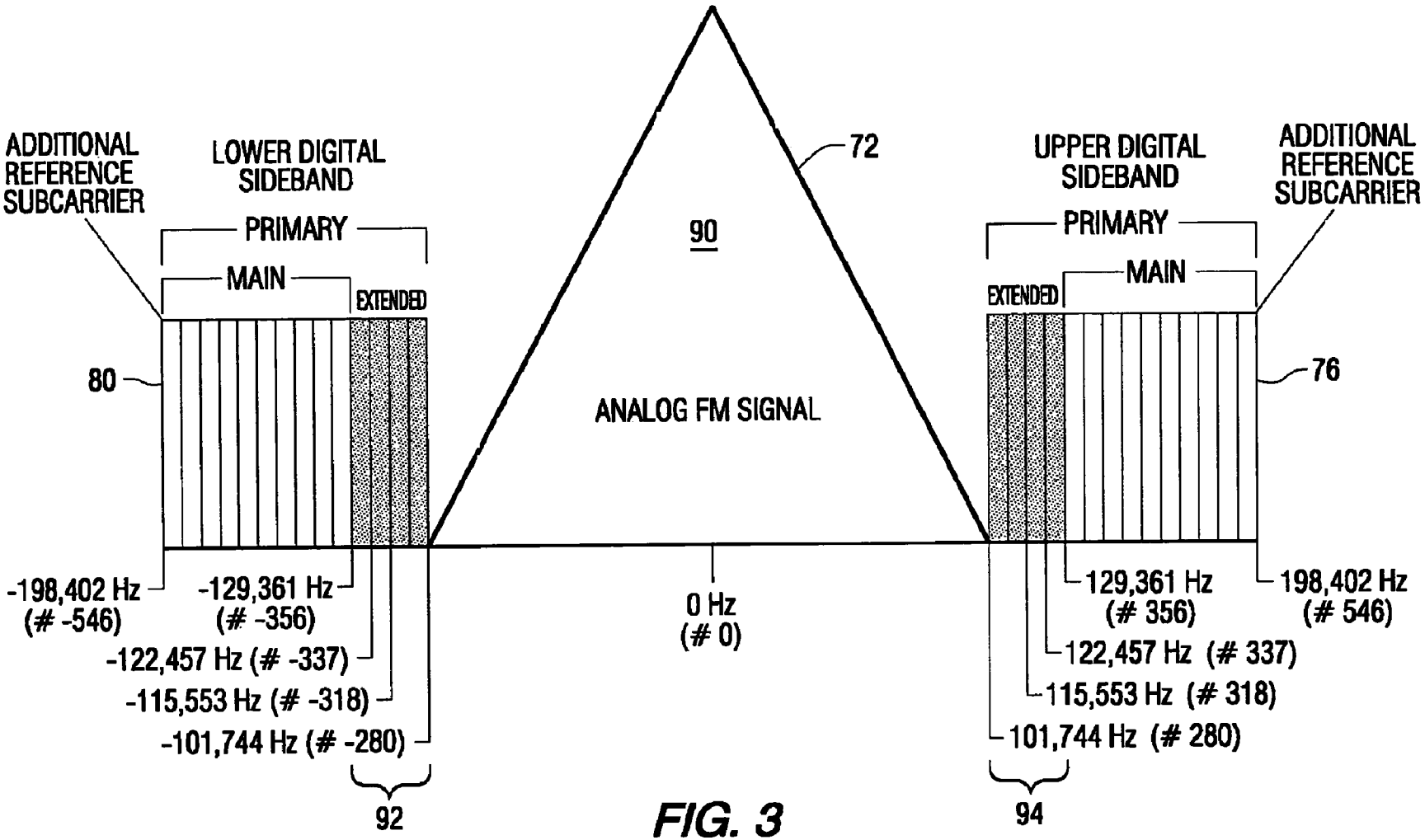
FIG. 3 is a schematic representation of an exemplary extended hybrid FM IBOC waveform.

FIG. 3 is a schematic representation of an extended hybrid FM IBOC waveform 90. The extended hybrid waveform is created by adding primary extended sidebands 92, 94 to the primary main sidebands present in the hybrid waveform. One, two, or four frequency partitions can be added to the inner edge of each primary main sideband. The extended hybrid waveform includes the analog FM signal plus digitally modulated primary main subcarriers (subcarriers +356 to +546 and −356 to −546) and some or all primary extended subcarriers (subcarriers +280 to +355 and −280 to −355).

The upper primary extended sidebands include subcarriers 337 through 355 (one frequency partition), 318 through 355 (two frequency partitions), or 280 through 355 (four frequency partitions). The lower primary extended sidebands include subcarriers −337through −355 (one frequency partition), −318 through −355 (two frequency partitions), or −280 through −355 (four frequency partitions). The amplitude of each subcarrier can be scaled by an amplitude scale factor.

Figure 4:
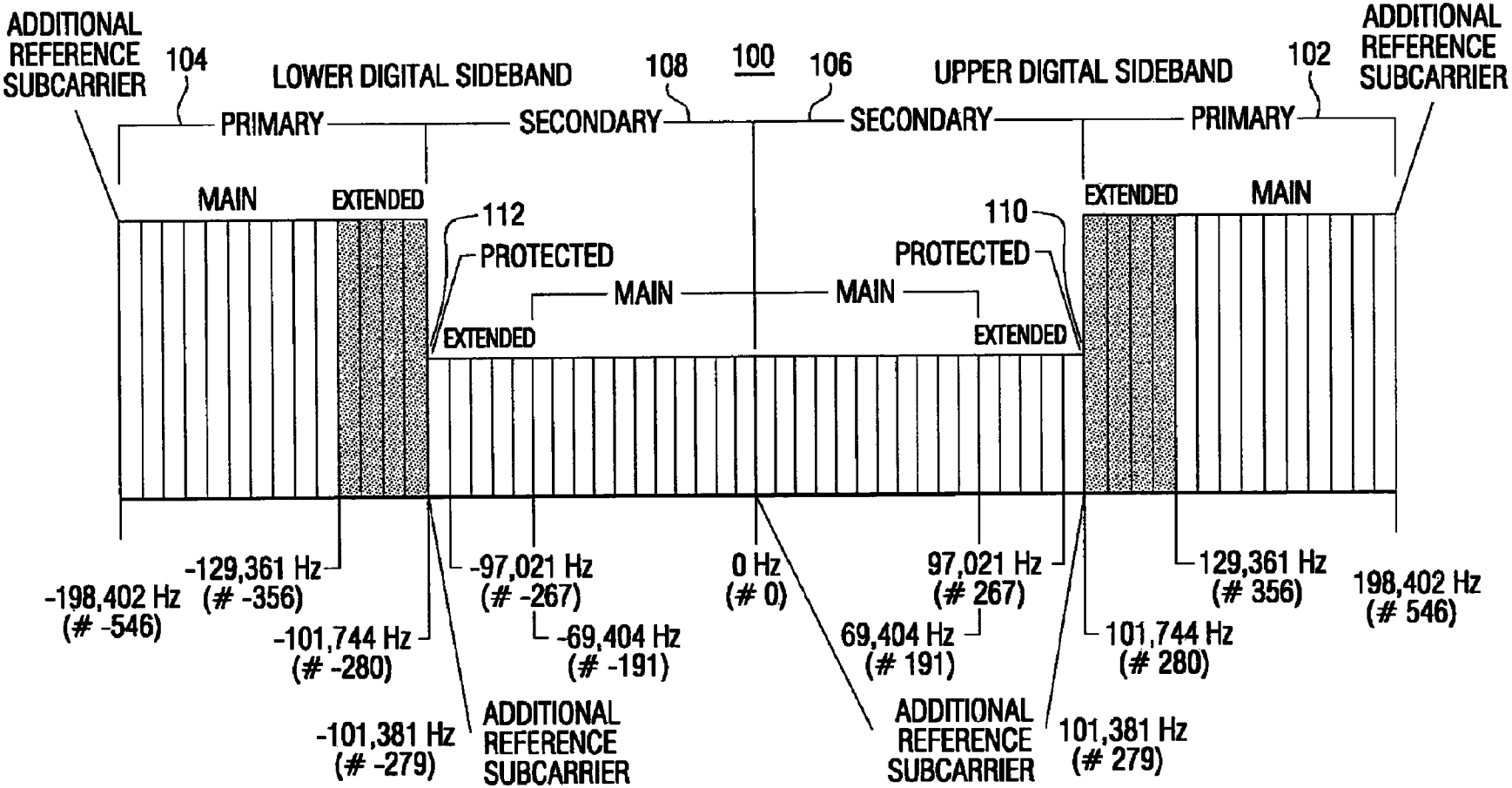
FIG. 4 is a schematic representation of an exemplary all-digital FM IBOC waveform.

FIG. 4 is a schematic representation of an all-digital FM IBOC waveform 100. The all-digital waveform is constructed by disabling the analog signal, fully expanding the bandwidth of the primary digital sidebands 102, 104, and adding lower-power secondary sidebands 106, 108 in the spectrum vacated by the analog signal. The all-digital waveform in the illustrated embodiment includes digitally modulated subcarriers at subcarrier locations—546 to +546, without an analog FM signal.

In addition to the ten main frequency partitions, all four extended frequency partitions are present in each primary sideband of the all-digital waveform. Each secondary sideband also has ten secondary main (SM) and four secondary extended (SX) frequency partitions. Unlike the primary sidebands, however, the secondary main frequency partitions are mapped nearer to the channel center with the extended frequency partitions farther from the center.

Each secondary sideband also supports a small secondary protected (SP) region 110, 112 including 12 OFDM subcarriers and reference subcarriers 279 and −279. The sidebands are referred to as "protected" because they are located in the area of spectrum least likely to be affected by analog or digital interference. An additional reference subcarrier is placed at the center of the channel (0). Frequency partition ordering of the SP region does not apply since the SP region does not contain frequency partitions.

Each secondary main sideband spans subcarriers 1 through 190 or −1 through −190. The upper secondary extended sideband includes subcarriers 191 through 266, and the upper secondary protected sideband includes subcarriers 267 through 278, plus additional reference subcarrier 279. The lower secondary extended sideband includes subcarriers −191 through −266, and the lower secondary protected sideband includes subcarriers −267 through −278, plus additional reference subcarrier −279. The total frequency span of the entire all-digital spectrum is 396,803 Hz. The amplitude of each subcarrier can be scaled by an amplitude scale factor. The secondary sideband amplitude scale factors can be user selectable. Any one of the four may be selected for application to the secondary sidebands.

In each of the waveforms, the digital signal is modulated using orthogonal frequency division multiplexing (OFDM). OFDM is a parallel modulation scheme in which the data stream modulates a large number of orthogonal subcarriers, which are transmitted simultaneously. OFDM is inherently flexible, readily allowing the mapping of logical channels to different groups of subcarriers.

In the hybrid waveform, the digital signal is transmitted in primary main (PM) sidebands on either side of the analog FM signal in the hybrid waveform. The power level of each sideband is appreciably below the total power in the analog FM signal. The analog signal may be monophonic or stereo, and may include subsidiary communications authorization (SCA) channels.

In the extended hybrid waveform, the bandwidth of the hybrid sidebands can be extended toward the analog FM signal to increase digital capacity. This additional spectrum, allocated to the inner edge of each primary main sideband, is termed the primary extended (PX) sideband.

In the all-digital waveform, the analog signal is removed and the bandwidth of the primary digital sidebands is fully extended as in the extended hybrid waveform. In addition, this waveform allows lower-power digital secondary sidebands to be transmitted in the spectrum vacated by the analog FM signal.

Figure 5:
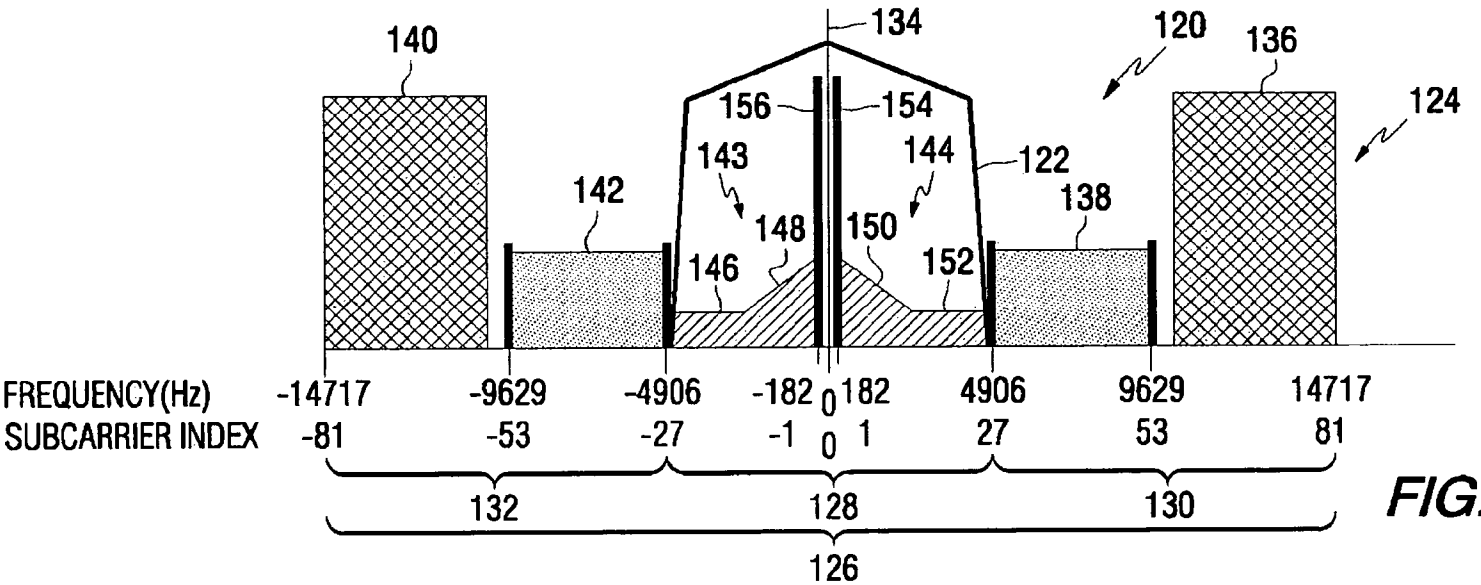
FIG. 5 is a schematic representation of an exemplary hybrid AM IBOC DAB waveform.

FIG. 5 is a schematic representation of an AM hybrid IBOC DAB waveform 120. The hybrid format includes the conventional AM analog signal 122 (bandlimited to about ±5 kHz) along with a nearly 30 kHz wide DAB signal 124. The spectrum is contained within a channel 126 having a bandwidth of about 30 kHz. The channel is divided into upper 130 and lower 132 frequency bands. The upper band extends from the center frequency of the channel to about +15 kHz from the center frequency. The lower band extends from the center frequency to about −15 kHz from the center frequency.

The AM hybrid IBOC DAB signal format in one example comprises the analog modulated carrier signal 134 plus OFDM subcarrier locations spanning the upper and lower bands. Coded digital information representative of the audio or data signals to be transmitted (program material), is transmitted on the subcarriers. The symbol rate is less than the subcarrier spacing due to a guard time between symbols.

As shown in FIG. 5, the upper band is divided into a primary section 136, a secondary section 138, and a tertiary section 144. The lower band is divided into a primary section 140, a secondary section 142, and a tertiary section 143. For the purpose of this explanation, the tertiary sections 143 and 144 can be considered to include a plurality of groups of subcarriers labeled 146, 148, 150 and 152 in FIG. 5. Subcarriers within the tertiary sections that are positioned near the center of the channel are referred to as inner subcarriers, and subcarriers within the tertiary sections that are positioned farther from the center of the channel are referred to as outer subcarriers. In this example, the power level of the inner subcarriers in groups 148 and 150 is shown to decrease linearly with frequency spacing from the center frequency. The remaining groups of subcarriers 146 and 152 in the tertiary sections have substantially constant power levels. FIG. 5 also shows two reference subcarriers 154 and 156 for system control, whose levels are fixed at a value that is different from the other sidebands.

The power of subcarriers in the digital sidebands is significantly below the total power in the analog AM signal. The level of each OFDM subcarrier within a given primary or secondary section is fixed at a constant value. Primary or secondary sections may be scaled relative to each other. In addition, status and control information is transmitted on reference subcarriers located on either side of the main carrier. A separate logical channel, such as an IBOC Data Service (IDS) channel can be transmitted in individual subcarriers just above and below the frequency edges of the upper and lower secondary sidebands. The power level of each primary OFDM subcarrier is fixed relative to the unmodulated main analog carrier. However, the power level of the secondary subcarriers, logical channel subcarriers, and tertiary subcarriers is adjustable.

Using the modulation format of FIG. 5, the analog modulated carrier and the digitally modulated subcarriers are transmitted within the channel mask specified for standard AM broadcasting in the United States. The hybrid system uses the analog AM signal for tuning and backup.

Figure 6:
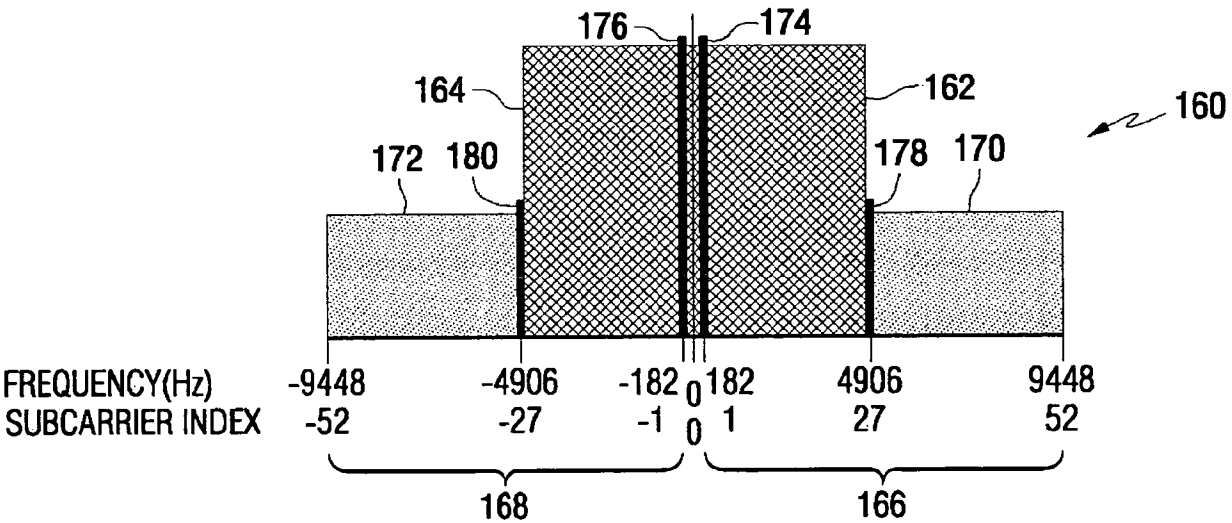
FIG. 6 is a schematic representation of an exemplary all-digital AM IBOC DAB waveform.

FIG. 6 is a schematic representation of the subcarrier assignments for an all-digital AM IBOC DAB waveform. The all-digital AM IBOC DAB signal 160 includes first and second groups 162 and 164 of evenly spaced subcarriers, referred to as the primary subcarriers, that are positioned in upper and lower bands 166 and 168. Third and fourth groups 170 and 172 of subcarriers, referred to as secondary and tertiary subcarriers respectively, are also positioned in upper and lower bands 166 and 168. Two reference subcarriers 174 and 176 of the third group lie closest to the center of the channel. Subcarriers 178 and 180 can be used to transmit program information data.

Figure 7:
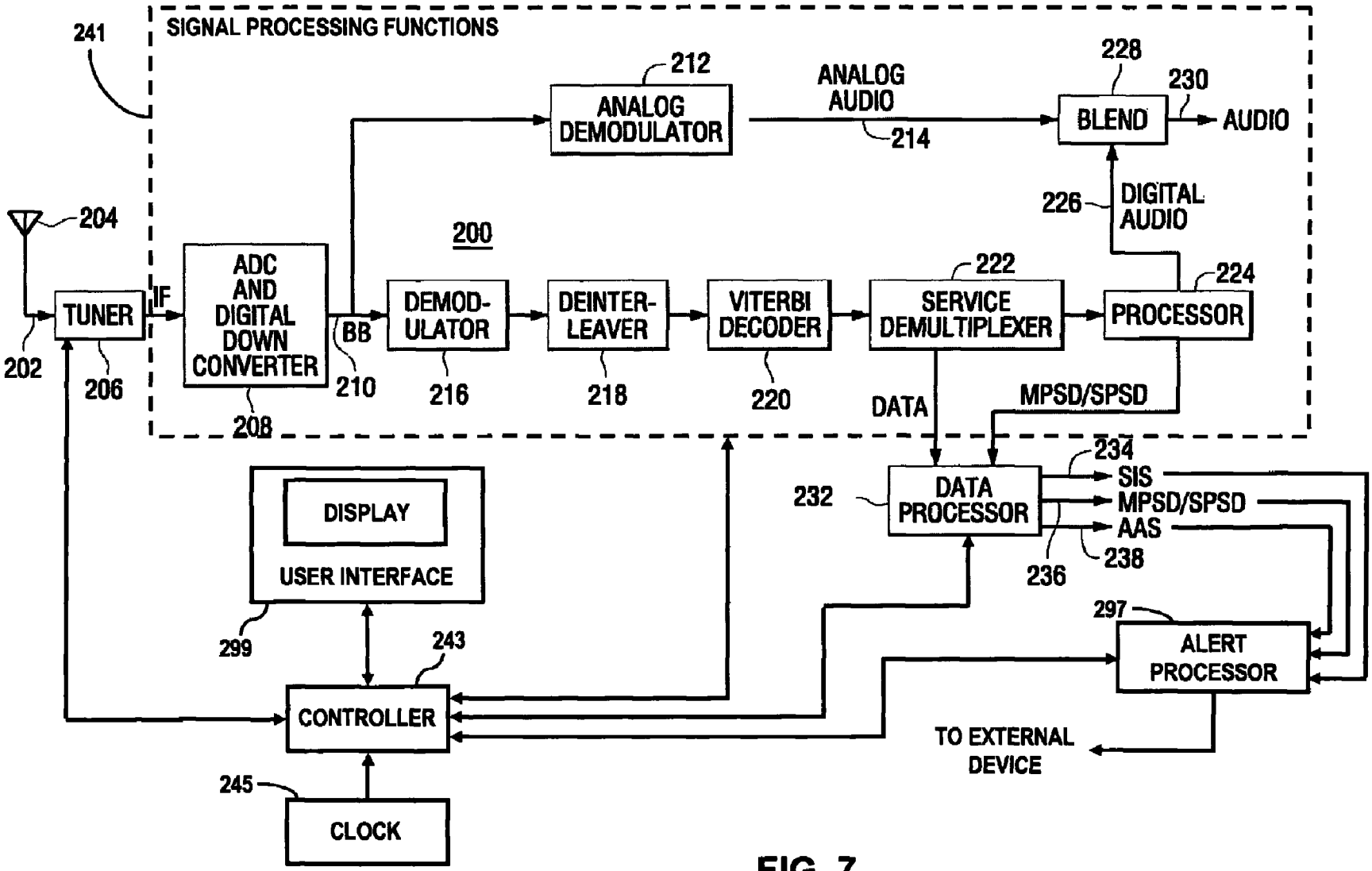
FIG. 7 is a functional block diagram of an exemplary AM IBOC DAB receiver.

FIG. 7 is a simplified functional block diagram of an AM IBOC DAB receiver 200. The receiver includes an input 202 connected to an antenna 204, a tuner or front end 206, and a digital down converter 208 for producing a baseband signal on line 210. An analog demodulator 212 demodulates the analog modulated portion of the baseband signal to produce an analog audio signal on line 214. A digital demodulator 216 demodulates the digitally modulated portion of the baseband signal. Then the digital signal is deinterleaved by a deinterleaver 218, and decoded by a Viterbi decoder 220. A service demultiplexer 222 separates main and supplemental program signals from data signals. A processor 224 processes the program signals to produce a digital audio signal on line 226. The analog and main digital audio signals are blended as shown in block 228, or a supplemental digital audio signal is passed through, to produce an audio output on line 230. A data processor 232 processes the data signals and produces data output signals on lines 234, 236 and 238. The data signals can include, for example, a station information service (SIS), main program service data (MPSD), supplemental program service data (SPSD), and one or more auxiliary application services (AAS). Also shown is an alert processor 297, a controller 243, a clock 245, and a user interface 299, which are further discussed below.

Figure 8:
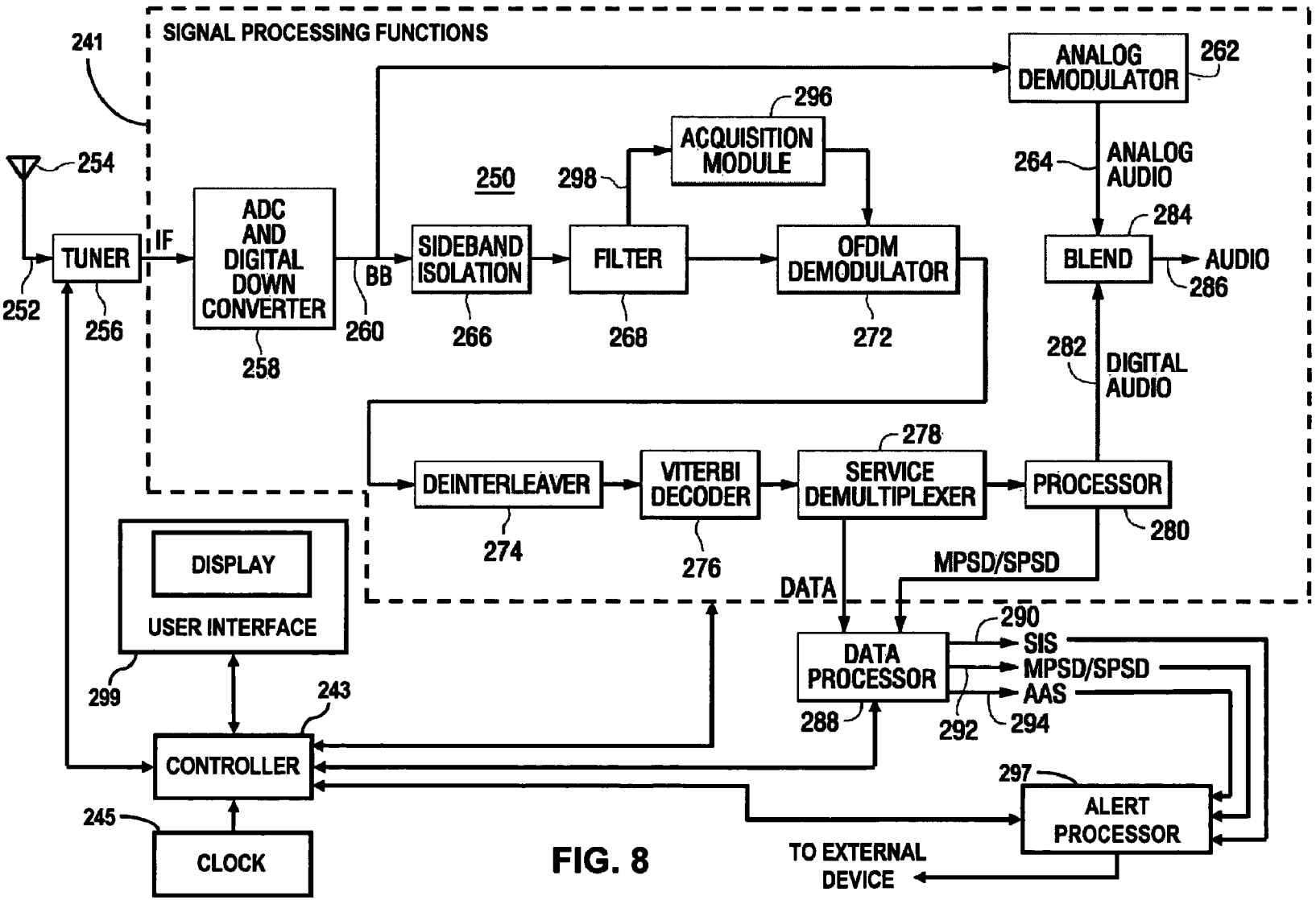
FIG. 8 is a functional block diagram of an exemplary FM IBOC DAB receiver.

FIG. 8 is a simplified functional block diagram of an FM IBOC DAB receiver 250. The receiver includes an input 252 connected to an antenna 254 and a tuner or front end 256. A received signal is provided to an analog-to-digital converter and digital down converter 258 to produce a baseband signal at output 260 comprising a series of complex signal samples. The signal samples are complex in that each sample comprises a "real" component and an "imaginary" component, which is sampled in quadrature to the real component. An analog demodulator 262 demodulates the analog modulated portion of the baseband signal to produce an analog audio signal on line 264. The digitally modulated portion of the sampled baseband signal is next filtered by sideband isolation filter 266, which has a pass-band frequency response comprising the collective set of subcarriers $f_1$-$f_n$ present in the received OFDM signal. Filter 268 suppresses the effects of a first-adjacent interferer. Complex signal 298 is routed to the input of acquisition module 296, which acquires or recovers OFDM symbol timing offset or error and carrier frequency offset or error from the received OFDM symbols as represented in received complex signal 298. Acquisition module 296 develops a symbol timing offset $\Delta t$ and carrier frequency offset $\Delta f$, as well as status and control information. The signal is then demodulated (block 272) to demodulate the digitally modulated portion of the baseband signal. Then the digital signal is deinterleaved by a deinterleaver 274, and decoded by a Viterbi decoder 276. A service demultiplexer 278 separates main and supplemental program signals from data signals. A processor 280 processes the main and supplemental program signals to produce a digital audio signal on line 282. The analog and main digital audio signals are blended as shown in block 284, or the supplemental program signal is passed through, to produce an audio output on line 286. A data processor 288 processes the data signals and produces data output signals on lines 290, 292 and 294. The data signals can include, for example, a station information service (SIS), main program service data (MPSD), supplemental program service data (SPSD), and one or more advanced application services (AAS). Also shown is an alert processor 297, a controller 243, a clock 245, and a user interface 299, which are further discussed below.

Referring again to FIG. 1, the studio site 10 and/or transmitter site 12 also include an alert client, e.g., software module, such as either HDP 17 or HDP 19 (both may be present in some examples). Such an alert client may be referred to herein as an HDP. In some embodiments, the HDP 17 may be associated with the studio site 10. In other embodiments, the HDP 19 may be associated with the transmitter site 12 or may be associated with both the studio site 10 and the transmitter site 12. The HDP (e.g., either HDP 17 or HDP 19) receives an alert notification from an alert provider, parses the alert notification into an alert message, configures information of the alert message in a format suitable for the importer, and provides the alert message to the importer 18, the exciter 58 or both. If an HDP is associated with the importer 18, the HDP (i.e., HDP 17) may process primary alert information and optionally secondary information that provides more comprehensive information about the alert, as well as any attachments that may be associated with the alert message. The primary alert information and any secondary information are then forwarded to the importer 18 to be encoded and multiplexed into exporter link data 24. If an HDP is associated with exciter 58, the HDP (i.e., HDP 19) may provide primary alert information to the exciter to be included with the exciter 56 output, since for example, the exciter 58 may not be configured to process secondary alert message information or a message attachment. Therefore, in some embodiments, HDP 17 may provide a more comprehensive alert message than HDP 19.

In general, the alert message, which is generated from the alert notification, can include three parts—primary alert information, secondary information, and message attachments. The primary alert information can be transmitted via an SIS signal and can include a relatively minimal amount of information required for a receiver to utilize/render the alert message. A non-limiting example of generating primary alert information will now be described.

In an exemplary embodiment, the alert notification may be received from an alert notification provider via an Emergency Alert Service (EAS) encoder/decoder (ENDEC) device located at a studio site 10 or a transmitter site 12 as known to those of ordinary skill in the art. An EAS ENDEC device may be referred to herein as an EAS box, as they are conventionally known in the art. The EAS box can have any suitable computer interface to allow it to communicate with a computing system at a studio site 10 or transmitter site 12, and such a computing system may include, for example, an importer 18 and/or an exciter 58 shown in FIG. 1. For emergency alerts, for example, the alert notification can comprise data structured according to the conventional Common Alerting Protocol (CAP) such as, for example, OASIS Common Alerting Protocol v 1.1, known to those of ordinary skill in the art, a description for which is available from the Organization for the Advancement of Structured Information Standards (OASIS) via the Internet at http://www.oasis-open.org. The CAP protocol format is a standard XML format used to exchange emergency alerts and public warnings over various types of networks. As known to those of skill in the art, the CAP protocol sets forth a template for the structure and types of information that can be processed by the EAS box. Such information may include, for example, a message ID, a sender ID, a send date, a message status, a message type, a message scope, an event category, an event update, urgency message, severity message, event certainty, event description and a geographic segment. Once the HDP receives the alert notification in CAP format from the EAS box, the HDP parses the alert notification to provide the alert message to the importer 18, the exciter 58, or both. For commercial alerts, an alert notification provider can provide a commercial alert notification by structuring the alert notification substantially as set forth by the CAP protocol, but specifying "commercial" as the event category instead of using the conventional event categories that relate to emergency alerts, for example. It will be appreciated that there can be multiple types of commercial event types associated with the "commercial" event category, which may be referred to herein generically as Commercial 1, Commercial 1, Commerical 3, etc., and such commercial event types may include, for example, availability of concert tickets, availability of certain pay-per-listen programming, etc. Reference to the CAP protocol herein should be understood as being one potential exemplary protocol for structuring alert notifications from notification providers, and other protocols including future protocols could be used such as may be agreed upon by broadcasters and alert notification providers, including providers of commercial alert notifications. Thus it will be appreciated that any suitable protocol can be used insofar as the protocol satisfies the needs of broadcasters and alert notification providers. Of course, the alert client (HDP) at the studio site or transmitter site will be suitably configured to process the alert notification, in conjunction with other devices such as an importer and exciter, into whatever form may be suitable for transmission by digital radio broadcast.

In exemplary embodiments, the HDP (or alternatively, the importer 18 or exciter 58) may parse information within the alert notification from an agency issuing the alert to determine the type of alert. For example, the HDP can correlate the extracted event type from the CAP event type field as discussed above to a table of type information codes such as shown in FIG. 10 and can place that event type code into a suitable field of a data structure that can be transmitted by digital radio broadcast transmission via any suitable channel, or further converted into a format suitable for digital radio broadcast transmission. For example, if an Amber alert is received from the police, the HDP or importer 18 may parse the alert notification from the police to determine that the alert was an Amber alert and to determine which portion of the alert notification from the police should be included in the message content. In general, any suitable process for applying the proper conversion can be used. The HDP, importer, or exciter can then assign an appropriate code (e.g., alphanumeric codes) as type information for the alert type at hand, such as shown, for example, in the table of FIG. 10 as discussed above. Alternatively, in an exemplary embodiment, the alert notification provider may transmit the alert notification in a format suitable for receipt by the HDP and/or importer 18 in FIG. 1 so that the HDP and/or importer 18 would not have to further construct an alert message.

Figure 9A:
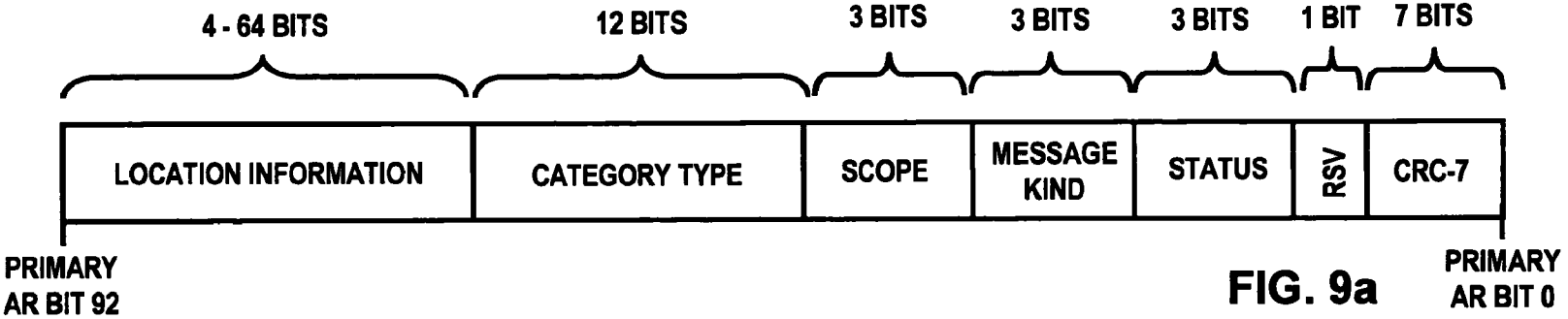
FIGS. 9*a* and 9*b* illustrates an exemplary data structure comprising a plurality of fields that can be generated from an alert notification received from an alert notification provider. The exemplary data structure shown in FIGS. 9*a* and 9*b* can also be reconstructed at a digital radio broadcast receiver from a digital radio broadcast signal.
Figure 9B:
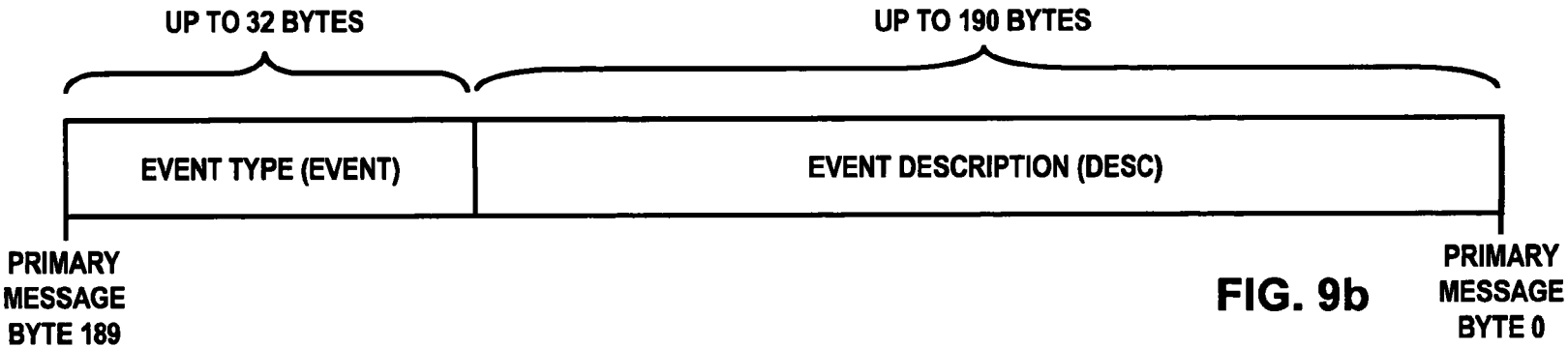

For example, after receiving an alert notification from an alert notification provider, an HDP may process the alert notification into a data structure such as shown in FIGS. 9*a* and 9*b*. FIGS. 9*a* and 9*b* show an exemplary illustration of primary alert information including type information (e.g., category type indicator in FIG. 9*a*) and message information (e.g., event type and event description) extracted from an alert notification received according to the CAP protocol. In the example of FIGS. 9*a* and 9*b*, the fields shown therein correspond to associated elements of the CAP protocol. The HDP can be configured to select such elements and/or any other desired elements from an alert notification in CAP protocol (or any other suitable protocol) and append them to form the fields of the exemplary data structure, such as shown in FIGS. 9*a* and 9*b*. The category type field in FIG. 9*a*, for example, corresponds to the category element of the CAP protocol, and can indicate the category or type of the alert (e.g., safety, geophysical, fire, rescue, etc). Generally, the type information (e.g., category type) should correspond to the categories that are selectable by the user as described in connection with FIGS. 15*a*-15*f* herein. In an exemplary embodiment, the type information can indicate more than one type of alert, e.g., the category type field in FIG. 9*a* can be of a size (e.g., 12 bits in size) so as to allow multiple categories to be indicated for a given alert (e.g., 2, 3, or 4 types of alerts). A 12-bit category type shown in FIG. 9*a* can provide for 2 types of alerts, each type being indicated by 6 bits, for example. Exemplary 6 bit type indicators are shown in the table of FIG. 10. In this exemplary embodiment, a 6-bit category type field supports up to 64 different alert types, including the types indicated for future use. The codes reserved for future use may be used for other commercial alerts or emergency alerts.

In the exemplary embodiment of FIG. 9*a*, the primary alert information may include a 7 bit cyclic redundancy check (CRC) to verify the integrity of the frame, a 3 bit status portion indicating, for example, whether the alert message is an actual message or a test message, among others (e.g., see Table 1 in FIG. 11), a 3 bit message kind portion (which may correspond to the "message type" field in the CAP protocol, for example) indicating whether the message is an update or cancellation of the alert message (e.g., see Table 2 in FIG. 11), and a 3 bit scope portion indicating the distribution level of the alert message, such as public, restricted, private, etc. (e.g., see Table 3 in FIG. 11).

Figure 9C:
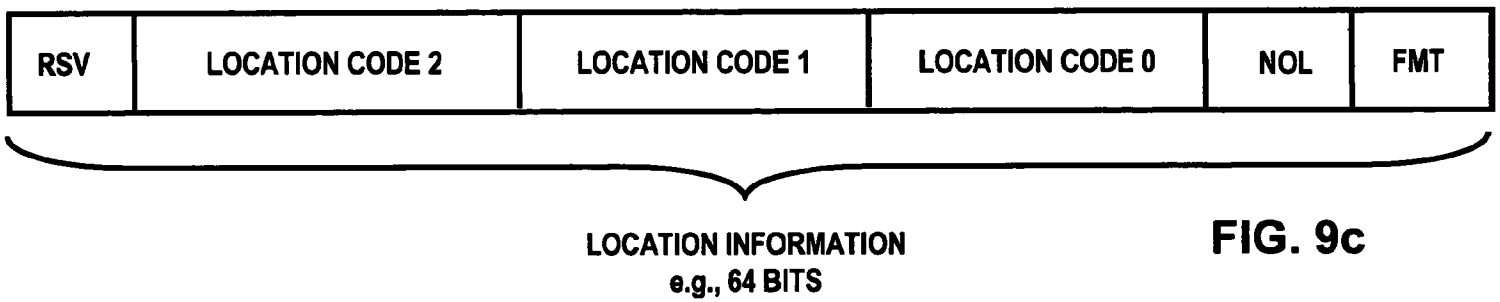
FIG. 9*c* illustrates an exemplary structure of a location portion of the exemplary data structure shown in FIG. 9*a*.

The primary alert information shown in the example of FIG. 9*a* may include location information (e.g., include 4-64 bits of location information in this example) that can be used to further trigger the receiver as described elsewhere herein. In an exemplary embodiment, the location information may include up to three location codes as shown in FIG. 9*c*. The location information may also include a 2 bit format identifier (FMT) to identify whether the location format is a zip code (ZIP), Specific Area Message Encoding (SAME), or Federal Information Processing Standard (FIPS), for example (e.g., see Table 1 in FIG. 12) and a 2 bit field to identify the number of location codes included (NoL) (e.g., see Table 2 in FIG. 12). The ZIP, FIPS, and SAME formats are known to those of ordinary skill in the art. Briefly, the ZIP format corresponds to conventional 5-digit zip codes. FIPS is a standard issued by National Institute of Standards and Technology (NIST), and includes all states and counties in the U.S. or territories of the U.S., as well as other places that may be requested to be added to the standard. The standard uses a 6 digit code in the format "PSSCCC" for each identified location. "SS" stands for state (or equivalent). "CCC" stands for county (or equivalent). "P" stands for county subdivision and is optional within the FIPS standard. If not used or not applicable, it is set to 0 (zero). SAME is a standard issued by the National Weather Service and describes the affected area by means of six digits code in the format "PSSCCC". It is compatible with FIPS and includes its own expansions, as set by the National Weather Service. In the example of FIG. 9*c* showing three locations codes structured in a 64-bit field, if the ZIP format (5 digits) is used for all three location codes, 9 reserved bits (RSV) may be present since the ZIP format uses 17 bits per location code instead of 20 bits per location code as used in FIPS and SAME.

FIG. 9*b* shows an exemplary illustration of the message information portion of the overall primary alert information shown in FIGS. 9*a* and 9*b*. Generally, the message information of the primary alert message may need to satisfy some length requirement to suit a format into which that information is ultimately converted for digital radio broadcast transmission. In the example of FIG. 9*b*, the message information may be limited to a certain length (e.g., 190 bytes) to facilitate the ultimate transmission of corresponding information via a SIS signal via digital radio broadcast. It is possible that more than one element in the alert provider's notification may provide text associated with an alert, and it may be desirable to construct the message information for the alert message using text from multiple sections of the alert notification. For example, in FIG. 9*b*, the message information is constructed from information from the event description element of the CAP protocol (DESC) and the event type element of the CAP protocol (EVENT). In this example, it is desirable to limit the sum of the sizes of these two portions to 190 bytes to facilitate transmission via a SIS signal. Generally, if such a size limitation is exceeded (whatever the actual size limit for a given protocol or transmission format), truncation can be carried out to satisfy any such size limits as discussed herein in connection with FIG. 13. It is possible, of course, that there may be no predetermined limitations on alert message size.

In addition to primary alert information, the HDP and/or importer 18 can generate secondary information that provides a more comprehensive description of the alert and/or that provides a message attachment. Such secondary information can be transmitted, for example, via AAS, MPSD, SPSD, etc. In one example, the secondary information can reproduce some portion of the primary alert information (e.g., some or all of either the event description or the event category) such that when the receiver receives and processes the secondary information, the receiver can determine that the secondary information is related to the primary alert information, i.e., that both the primary alert information and the secondary information pertain to the same alert message. For example, the secondary information may include the same 93 primary AR bits as the primary alert information so that the secondary information can be correlated to the primary alert information. As another example, an AAS signal can also be associated with a system information guide (SIG) transmission, such that the SIG transmission provides a description, e.g., a directory, of what is being transmitted over the AAS signal. The SIG transmission may include some portion of the primary alert information so as to associate the secondary information to the primary alert information. When the digital radio broadcast receiver receives an AAS signal, the alert processor 297 of the digital radio broadcast receiver can check the SIG transmission for such identifying information and thus correlate the primary alert information and the secondary information. As a further example, the primary alert information can include an indicator or flag, such as a single bit or sequence of bits, that indicates that secondary information (e.g., more comprehensive message text) is being transmitted via an AAS signal, e.g., a fixed port (or logical address) within the AAS system dedicated for alert services. Also, the primary alert information can include another indicator or flag, such as a single bit or sequence of bits, indicating that a message attachment is included via an AAS signal. Message attachments can provide supplemental information about the alert. For example, in exemplary embodiments, the message attachment may be a photo or a map that provides additional information related to the alert. The message attachment may be associated with the primary message in any suitable manner, such as in the manner described above with respect to secondary information. While the above-described example refers to transmitting primary alert information and secondary information via a combination of SIS and AAS transmissions, the description is exemplary, and it should be understood that both primary alert information and secondary information may be transmitted and received in connection with other signals such as MPSD and SPSD, separately or in combination with SIS, AAS, and SIG such as described above. As would be understood by a person of ordinary skill in the art, any suitable method for constructing a data signal comprising primary alert information and optionally secondary information may be utilized.

Figure 13:
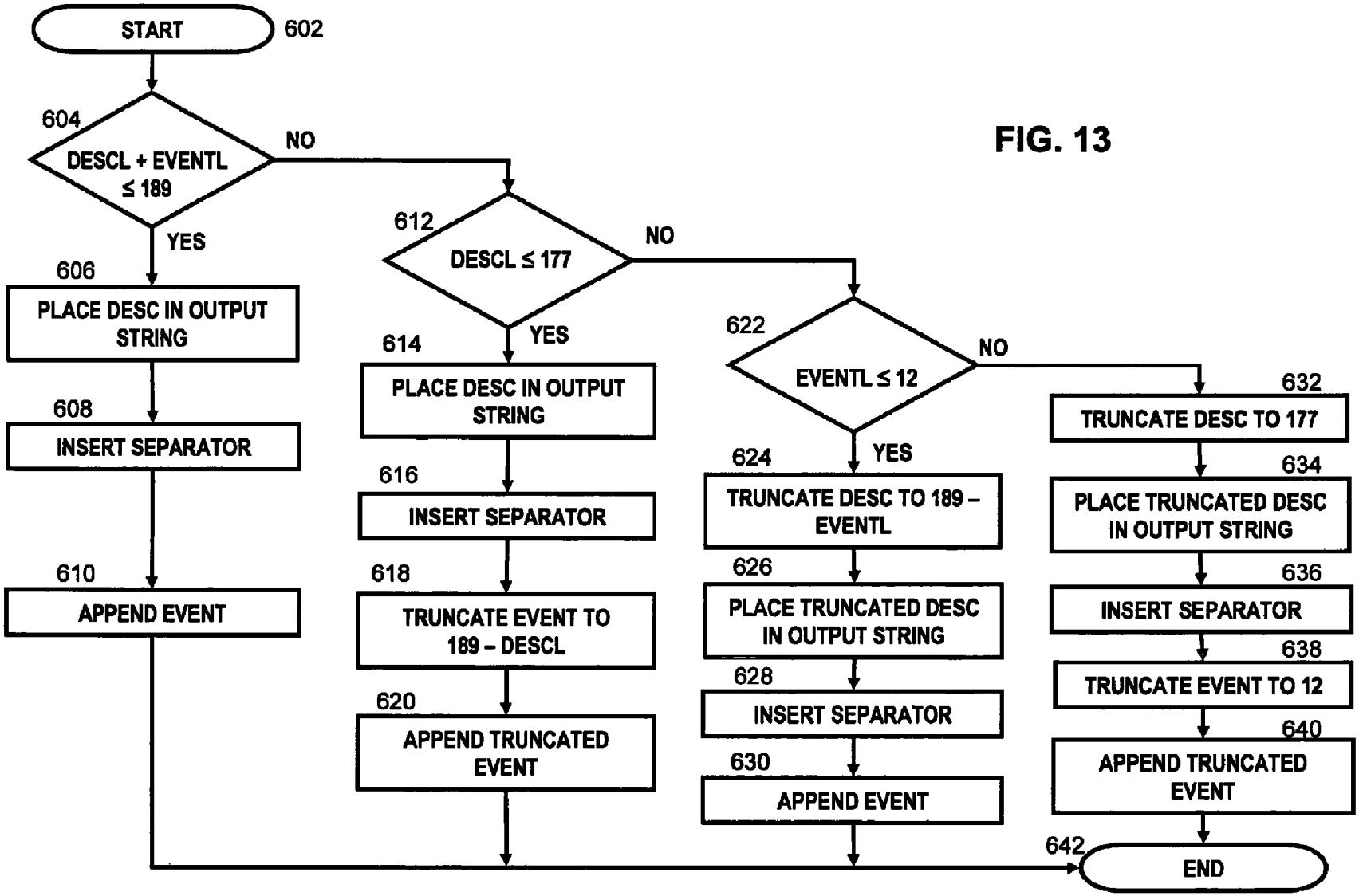
FIG. 13 shows an exemplary flow chart illustrating truncation of message information that can be carried out by an exemplary alert client (referred to as an HDP), e.g., a software module, at a studio site and/or a transmitter site.

FIG. 13 illustrates an exemplary flow chart for how the HDP can process the alert provider notification to ensure that the message information shown in FIG. 9*b* of the primary alert information is limited to 190 bytes. The HDP parses the alert notification such as described above and extracts the event description (DESC) from the CAP description element and extracts the event type (EVENT) from the CAP event type element. The event description (DESC) provides a description of the event and the event type (EVENT) provides text indicating the type of event. As shown in FIG. 13, the process starts at step 602, and at step 604, the HDP determines whether DESCL (description length)+"EVENTL" (event type length)≦189 bytes. If it is less than 189 bytes, DESC is placed in the output string at step 606, a separator (e.g., a one-character backslash) is appended to the output string at step 608, and EVENT is appended to the output string at step 610. The process ends at step 642 with an output string that is no greater than 190 bytes. If the sum in step 604 is greater than 189 bytes, the process continues to step 612 where the HDP determines whether DESCL≦177. If the length is less than 177 bytes, DESC is placed in the output string at step 614, a separator is appended to the output string at step 616, EVENT is truncated to 189—DESCL at step 618 and the truncated EVENT is appended to the output string at step 620. The process ends at step 642 with an output string that is no greater than 190 bytes. If DESCL is greater than 177 bytes at step 612, the process continues to step 622 to determine whether EVENTL≦12 bytes. If EVENTL is less than 12 bytes, DESC is truncated to 189—EVENTL at step 624, the truncated DESC is placed in the output string at step 626, a separator is appended to the output string at step 628, and EVENT is appended to the output string at step 630. The process ends at step 642 with an output string that is no greater than 190 bytes. If EVENTL at step 622 is greater than 12, DESC is truncated to 177 bytes at step 632, the truncated DESC is placed in the output string at step 634, a separator is appended to the output string at step 636, EVENT is truncated to 12 bytes at step 638, and the truncated EVENT is appended to the output string at step 640. The process ends at step 642 with an output string that is no greater than 190 bytes. In this way, the HDP can process an alert notification to extract an event description and an event type whose combined length satisfies SIS constraints. It will be appreciated that FIG. 13 is exemplary in nature and that the various byte lengths could be adjusted to suit constraints associated with transmitting alert information over signals other than SIS.

It should be understood that the field sizes and size requirements referred to above are only exemplary and should not be viewed as limiting in any way, as different field designations, field sizes, and size requirements can be selected to suit whatever protocols and formats are used for receipt of alert notifications from providers and for transmission via digital radio broadcasts.

Figure 14:
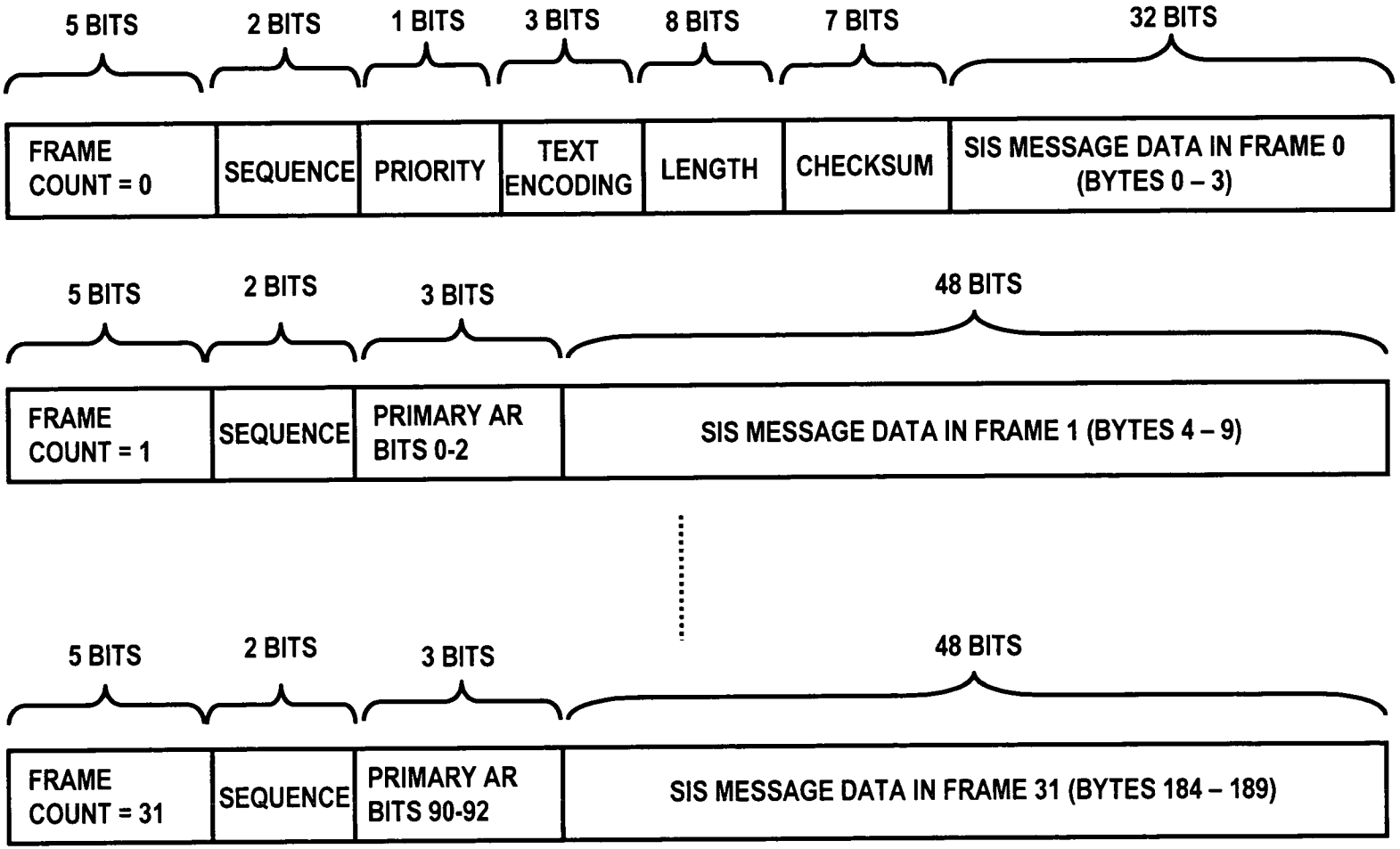
FIG. 14 illustrates multiple exemplary frames of data that can be generated by an HDP from the data structure of FIGS. 9*a* and 9*b* for transmission via digital radio broadcast.

FIG. 14 illustrates an exemplary representation of a data structure suitable for SIS transmission containing primary alert information that has been generated by the HPD by converting the information from the data structure shown in FIGS. 9*a* and 9*b*. Such a conversion step may be desirable depending upon the format and data channel utilized for transmission by digital radio broadcast. In other examples, such conversion may not be necessary, and it may be appropriate to convert information from the alert notification from the provider directly into a format suitable for digital radio broadcast transmission. Also, the data structure shown in FIG. 14 comprises multiple frames, but in other examples, it may be appropriate to format such information in a single frame. The data structure shown in the example of FIG. 14 is formatted to facilitate transmission of the primary alert information via SIS transmission according to the physical layer requirements thereof. It will be appreciated that this description is exemplary and non-limiting and that conversion to other formats can be done as may be desired for transmission via other data channels (e.g., AAS, MSPD, SPSD, SIG, etc.). It should be appreciated that the data structure illustrated in FIG. 14 can also be generated in the importer 18 or exciter 58.

As shown in the example of FIG. 14 for transmission via SIS, the HDP can structure the information into a series of multiple (e.g., 32) frames for transmission. In FIG. 9, each exemplary SIS frame can include 58 bits. The first frame (Frame Count 0) can include, for example, a 5 bit frame count identifier for identifying the frame number within a particular sequence, a 2 bit sequence identified for identifying the particular sequence (i.e., group of 32 frames), a 1 bit priority code that is generally set to 1 if there is an alert message (e.g., in accordance with the conventional CAP protocol) and which would be set to 0 for other station message information not associated with an alert, a 3 bit text encoding field for identifying the type of text encoding (e.g., ASCII, ISO, etc.), an 8 bit length field for identifying the total number of bytes in the station message information (i.e., in all 32 frames), a 7 bit checksum for checking the integrity of the data, and 32 bits of SIS message data. Each of frames 2-32, can include, for example, a 5 bit frame count identifier, a 2 bit sequence identifier, 3 bits labeled primary AR (active receiver) bits, and 48 bits of SIS message data. The 3 bits of primary AR information from frames 2-32 correspond to and are generated from the 93-bit portion of the primary alert information shown in FIG. 9*a*. The 48-bit portions of frames 2-32 correspond to and are generated from the message information shown in FIG. 9*b*. The conversion of the information shown in FIGS. 9*a* and 9*b* to the format shown in FIG. 14 amounts to a straightforward mapping of fields, and can be carried out in any suitable way as would be appreciated by one of ordinary skill in the art. As is reflected in this example, it will be appreciated that the type information need not be structured as contiguous bits in a given field of a frame, but can be distributed among multiple, separated fields (such as the primary AR bits field in FIG. 14). Of course, the type information can be structured in a single, contiguous field of transmitted data as appropriate for the transmission format that may be utilized. Also, whereas the example above refers to transmitting the primary alert information via SIS transmission, primary alert information can be structured in any suitable way for transmission via another channel such as, for example, AAS, SIG, MPSD, and SPSD. In an exemplary embodiment, such as where commercial alerts are provided for, the type information may be transmitted using the SIS channel as described above, and the message information may be transmitted using another data channel, e.g., AAS, MPSD, SPSD, etc.

Exemplary operation of a digital radio broadcast receiver including user customization functionality and receipt and processing of an alert message by a receiver will now be described.

An alert processor 297 is shown in both FIGS. 7 and 8. The alert processor 297 can be implemented using any suitable processing system and can receive the SIS signal and any additional information associated with the alert message via a suitable channel such as, for example, AAS, SIG, MPSD and/or SPSD. In exemplary embodiments, the alert processor 297 may be implemented in its own processor as a software module within the IBOC DAB receiver. Alternatively, the alert processor 297 may be implemented within one or more other processors such as data processor 232 or data processor 288. The alert processor 297 is responsible for processing the primary alert information, e.g., received via SIS, and secondary information including any message attachments, e.g., received via AAS. The alert processor 297 can also control or relay information to an external device, e.g., for controlling the external device and/or for rending an alert message at the external device.

FIGS. 7 and 8 also illustrate a controller 243, a clock 245, and a user interface 299 including a display. In exemplary embodiments, the clock 245 may be coupled to the controller 243 which can control the power management functionality (sleep mode) by controlling the tuner 206/256, the user interface 299, the signal processing functions 241, the data processor 232/288, and the alert processor 297. The controller 243 may also control the user preferences selected via the user interface 299. Details regarding the processing (and rendering) of the alert message, user preferences, and power management are described below in more detail.

In practice, many of the signal processing functions 241 shown in the receivers of FIGS. 7 and 8 can be implemented using any suitable processing system which may include any suitable combination of one or more processing units, other integrated circuits, firmware, and/or software modules.

Figure 15A:
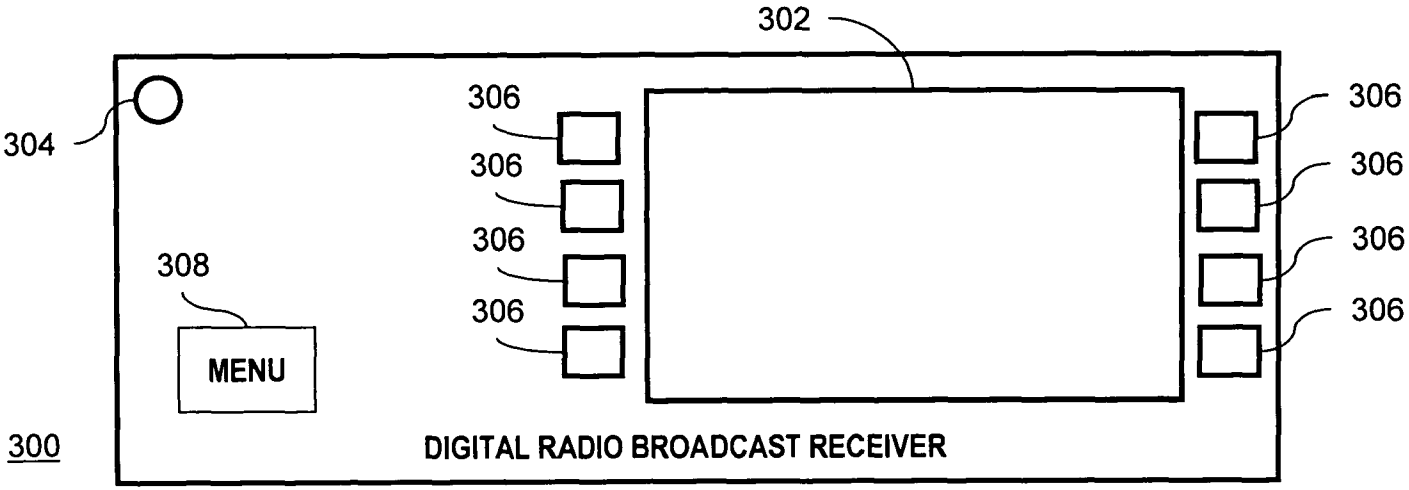
FIGS. 15*a*-15*f* illustrate an exemplary user interface for customizing a type of alert message to be rendered by a digital radio broadcast receiver.
Figure 15B:
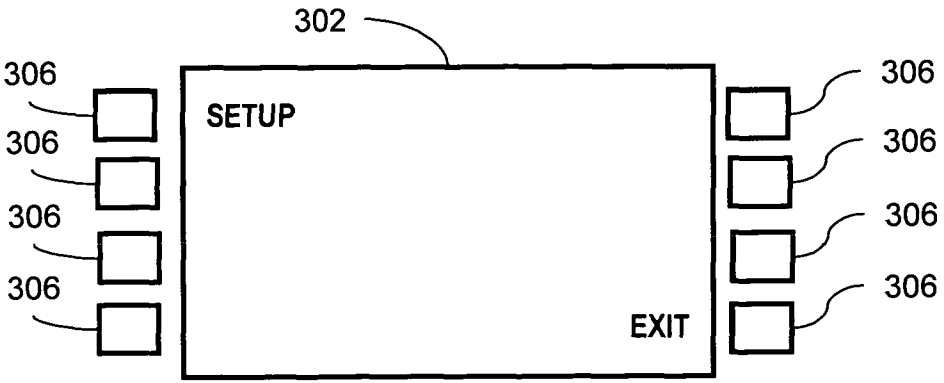

FIGS. 15*a*-15*f* illustrate an exemplary user interface for customizing a type of alert message to be rendered by a digital radio broadcast receiver. In FIG. 15*a*, the user interface is located on a front panel of a digital radio broadcast receiver 300. The front panel includes a display 302, power button 304, numerous soft keys 306 and a menu button 308. The display 302 may be a conventional LCD display or any other type of display known to a person of ordinary skill in the art. In normal operation the display 302 may be configured to show station call letters, the song name, the artist name, the current time, etc. In some embodiments, the digital radio broadcast receiver 300 may include additional keys for performing certain functions on the receiver. Additionally, the menu button 308 may, in certain embodiments, be configured to be associated with a soft key 306 instead of a hard key, as shown.

Figure 15C:
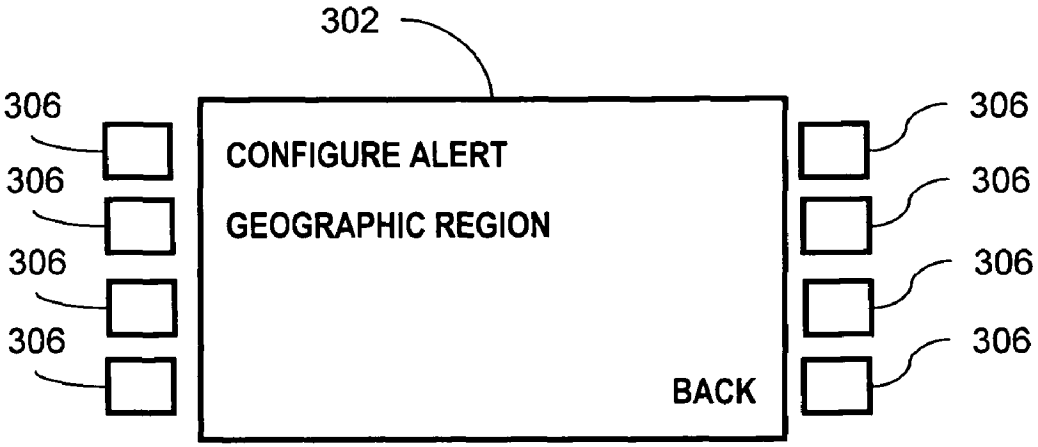

To customize which alert messages the user desires to be rendered (e.g., via audio, or visual display, or both), the user can select the menu button 308. Selection of the menu button 308 renders the information shown in FIG. 15*b* onto the display. In addition to a "setup" and "exit" feature associated with respective soft keys 306, additional menu items (such as, for tuning, selection of audio control parameters, etc.) may be displayed if appropriate. Selection of the "setup" option causes information to be displayed on the display 302 such as shown in FIG. 15*c*. If a user selects "configure alert", the information shown in FIG. 15*d* can be displayed on the display 302. Various alert message types can be displayed on display 302. Using the associated soft key 306, the user can select which alerts to render and which alerts to not render in a way that is customized for the user. For example, if the user desires to include "security alerts" in the customized list, the user can select the soft key 306 associated with the "security alerts". To deselect "security alerts", the user can select the soft key 306 associated with "security alerts" again. Various other methods for allowing a user to select and deselect available items could also be used. In an exemplary embodiment, a marker, such as a check mark, may be associated with the type of security alert so that the user would be able to identify which alerts were selected and whether pressing the associated soft key 306 was selecting or deselecting the particular type of alert. Alternatively, in another exemplary embodiment, the color of particular alerts may be changed based on whether the type of alert was selected or not.

Figure 15D:
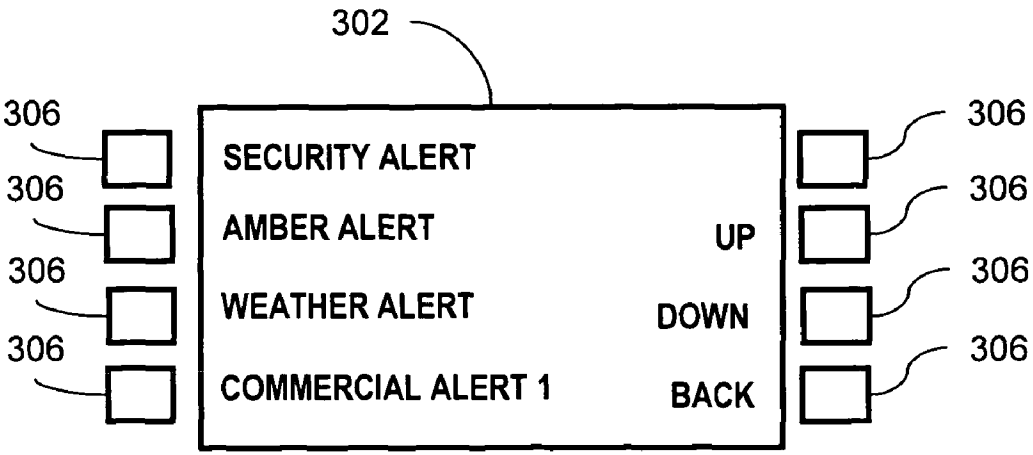

Additional soft keys 306 are shown that allow the user to move "up" or "down" in a list. This feature can be particularly useful if all of the alert types do not fit on the display. FIG. 15*d*, lists a security alert, an Amber alert, a weather alert, and a commercial alert 1 (e.g., an alert to notify a user of availability of concert tickets for a given artist). Of course, other types of alerts may also be configured. For example, other alerts that may be included may include any of a tornado alert, a hurricane alert, a wind alert, an earthquake alert, a fire alert, a pollution alert, a temperature alert, etc. Commercial alerts, as used herein, may include alerts regarding time-sensitive commercial product availability or time-sensitive commercial service availability. For example, alerts may be provided for particular stock quotes or when particular concert tickets are available. Commercial alerts may also be provided to trigger on-board recording or resume normal operation when a desired pay-per-listen program is available. Additionally, a commercial alert may be configured to adjust the volume automatically for particular types of programming and this type of functionality can be preconfigured by a receiver manufacturer or selectable by a user via the menu system of the user interface (similar functionality may also be provided in connection with emergency alerts).

Figure 15E:
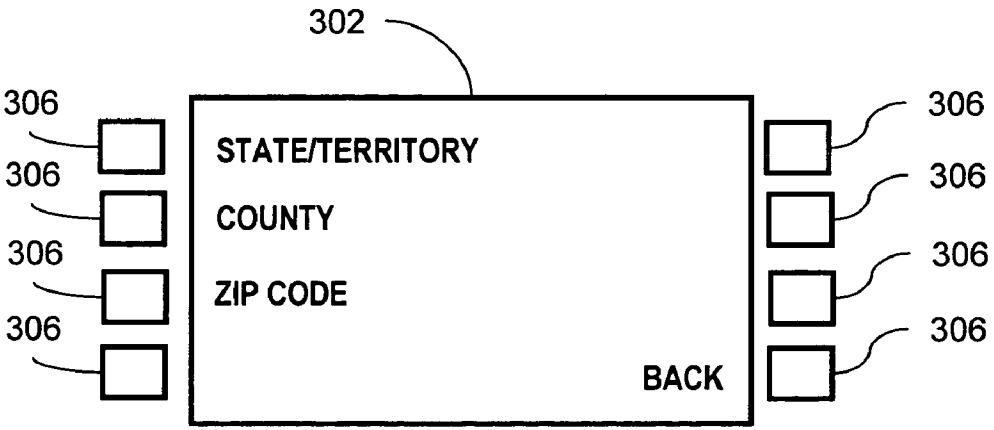
Figure 15F:
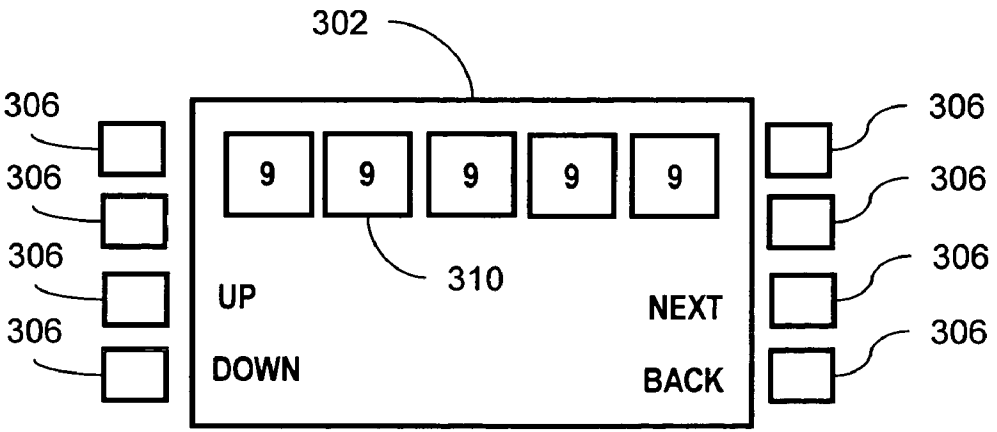

The receiver may be configured to allow the user to select a geographic region. In this case, the user selects "geographic region" in FIG. 15*c*, and the digital radio broadcast receiver can be configured to store location information pertaining to the location of the receiver. Specifically, certain of the alert messages, may benefit from knowledge of particular location information. As shown in FIG. 15*c*, if the user selects "geographic region" the information shown in FIG. 15*e* can be displayed on the display 302. FIG. 15*e* illustrates that the user may be provided with various options (e.g., state/territory, county, and zip code) for defining a particular geographic region. If, for example, the user selects "zip code" in FIG. 15*e*, the information shown in FIG. 15*f* can be displayed on the display 302 and the user can select a particular zip code by selecting a numerical value for each display portion 310. In the exemplary embodiment of FIG. 15*f*, the user can use the soft keys associated with the up and down functionality to select a particular number value (e.g., 0-9) and then select the soft key associated with "next" to select a number value for the next digit in the desired zip code. Alternatively, in some exemplary embodiments, a scrolling function may be provided to enable the user to select one of a predetermined geographic descriptor, such as a list of counties or states/territories.

Various alerts discussed above may be location specific, and it may only be desirable to trigger rendering of alerts of a particular type if it pertains to a particular geographic region. For example, a pollution alert might only be a desirable alert if it pertained to a particular city, or county, or zip code within which the user was located. In such a situation, the combination of the location information with the type information could be used to trigger particular alerts to be rendered if they satisfy the type of alert selected by the user and the geographic location selected by the user. Thus, in exemplary embodiments, the user is able to input his geographic region into the receiver by state/territory, county, or zip code, for example. This feature can even be useful for mobile receivers, such as in automobiles, since the user may desire to input the geographic location of his physical home, even though the automobile is mobile, so as to be notified, while driving, of any desired alerts that may impact his home.

The functionality illustrated in FIGS. 15*a*-15*f* can be implemented in a variety of ways. For example, the functionality can be programmed in any suitable language such a C, C+, C++, assembly language, etc., stored in any suitable computer readable medium and executed using any suitable combination of software and/or firmware. The selection of the actual coding implementation is within the purview of one of ordinary skill in the art in view of the functionality described herein.

In an exemplary embodiment, the digital radio broadcast receiver 300 may be initiated with particular default settings. In such an embodiment, the first time the user entered the menu to customize an alert list, the user may find that particular default types of alerts were pre-selected by, for example, the receiver manufacturer.

Figure 16:
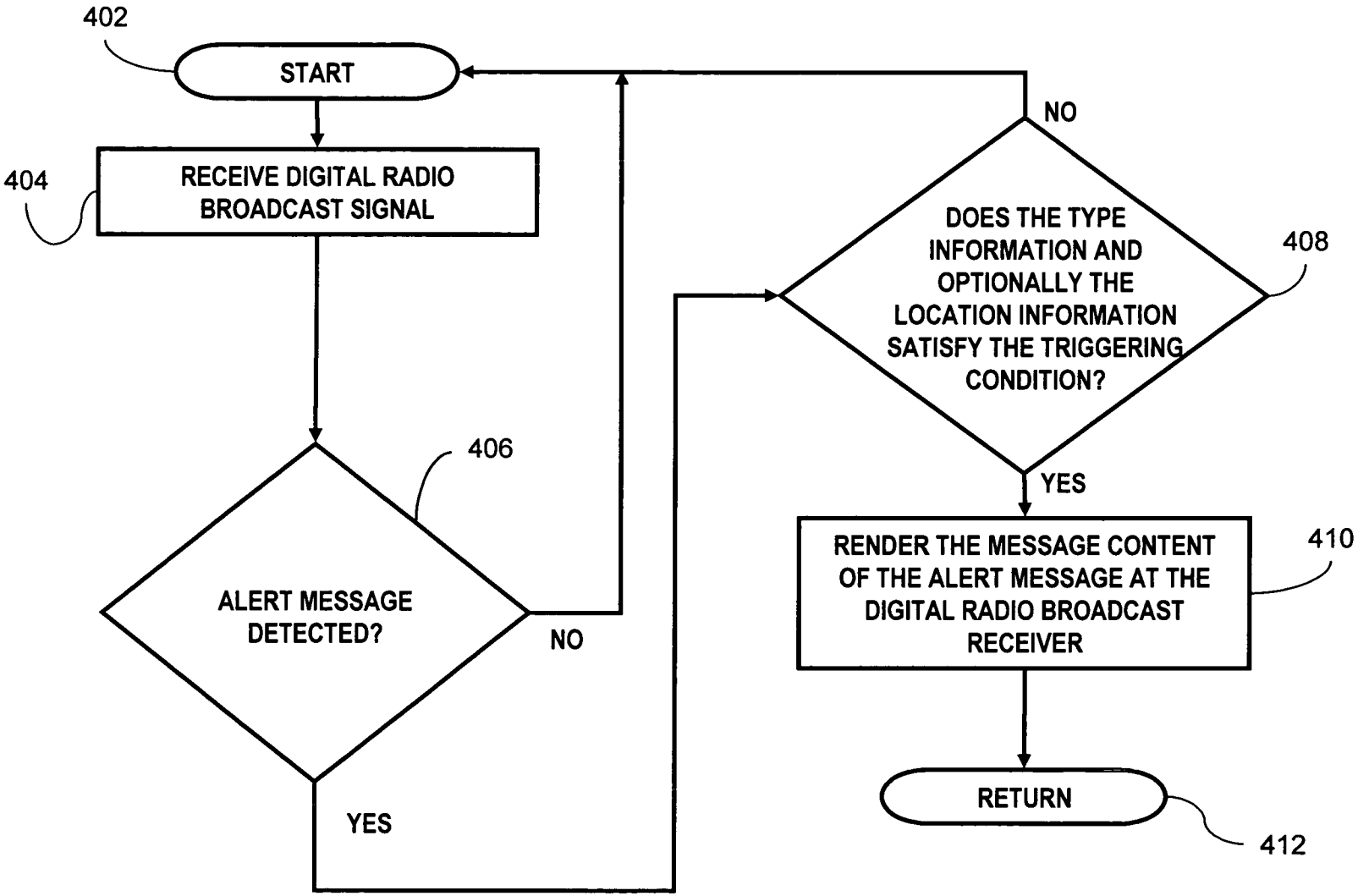
FIG. 16 shows an exemplary flow chart illustrating the operation of an exemplary digital radio broadcast receiver configured to render alert information.

FIG. 16 is a flow chart illustrating an exemplary method by which a digital radio broadcast receiver (e.g., an IBOC DAB receiver) can process and render alert information when already fully powered on. The process starts at step 402, and at step 404 the digital radio broadcast receiver receives a digital radio broadcast signal. For example, the signal may contain multiple frames of information such as illustrated in FIG. 14 received via SIS transmission. At step 406, the alert processor 297 (or any suitable processing system) of the digital radio broadcast receiver determines whether data corresponding to an alert message is detected. For example, the alert processor 297 can check whether the priority field of the first frame in FIG. 14 is set to "1" indicating that the SIS transmission corresponds to an alert message. If no data corresponding to an alert message is detected, the process returns to the start 402. At step 408, if data corresponding to an alert message is detected, the alert processor determines whether the type information, and optionally the location information, contained in the alert message satisfy a triggering condition whereby the type information and optionally the location information match type and location conditions selected by the user using the user interface 299 of the digital radio broadcast receive such as discussed in connection with FIGS.

15*a*-15*f*. For example, the alert processor 297 can parse and process a data structure such as shown in FIG. 14 so as to convert it into a data structure of the type illustrated in FIGS. 9*a*, 9*b* and 9*c*. This conversion process amounts to a reversal of the mapping previously carried out by the HDP in converting the data structure of FIGS. 9*a*, 9*b* and 9*c* into a data structure of the type illustrated in FIG. 14 prior to transmitting the SIS information corresponding to that shown in FIG. 14. The alert processor 297 can then compare the value of the category type field of the converted data structure shown in FIG. 9*a* (see also the Table of FIG. 10) with the selected category type codes stored in memory at the digital radio broadcast receiver as a result of the user's customization to see if there is a match. Optionally, the alert processor 297 can also compare the location code(s) stored in memory at the digital radio broadcast receiver with the location codes of the converted data structure such as shown in FIG. 9*c*. If the type information and optionally the location information satisfies a triggering condition for a type of alert message and optionally a location setting pre-selected by a user of the digital radio broadcast receiver (e.g., such as described, for example, with regard to FIGS. 15*a*-15*f*), the process proceeds to step 410. If the type information does not match a triggering condition, the process returns to the start 402. At step 410, if alert processor 297, having determined that the type information (and optionally location information) satisfies the triggering condition, the message information is rendered at step 412 either through an audio message, a visual display, or both. As discussed above the type information and the message information can be primary alert information transmitted via a SIS signal. The alert message may also include secondary information comprising a more comprehensive textual description of the alert message and/or a message attachment as described above. This secondary information can be automatically rendered after the message information of the primary alert information has been rendered. Alternatively, secondary information including any message attachments may not be rendered until a user makes a selection to render the secondary information including any message attachments by, for example, pressing a button on the receiver. At step 412, after the message information is rendered, the process returns to the start 402.

As noted above, the message information can include audio information to be rendered (e.g., provided audibly) at the digital radio broadcast receiver and/or visual information to be rendered (e.g., displayed) at the digital radio broadcast receiver. In an exemplary embodiment, the alert processor 297 of the digital radio broadcast receiver may be configured to convert textual data into audio information and may render the converted audio information. Additionally, in some embodiments, the alert message may include data corresponding to instructions for controlling an external device via any suitable communication interface of the digital radio broadcast receiver (e.g., USB, RS232, WiFi, Bluetooth, IEEE 802.15.4, ZigBee®, etc., as known to those of ordinary skill in the art), or for communicating information to be rendered at an external device. Exemplary devices that may be controlled in this manner, or that may receive information to be rendered, can include, for example, external displays, alarm controllers, light controllers, communication devices, or other types of devices.

In some embodiments, where the alert message comprises both primary alert information including type information and message information as well as secondary information (additional message information with further description and any message attachments), it is possible that the secondary information can be ignored if the digital radio broadcast receiver does not possess functionality to render the secondary information.

Figure 17:
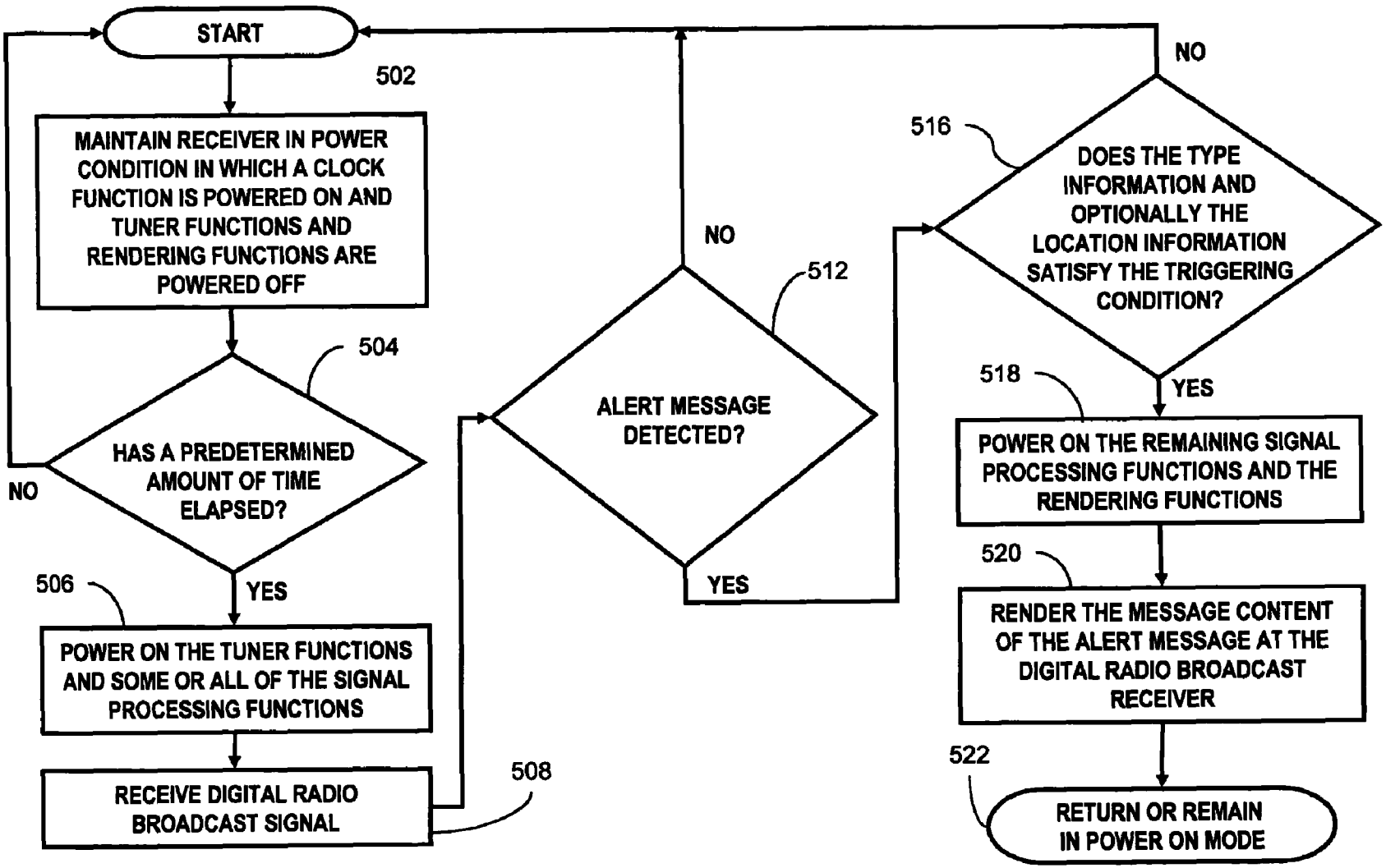
FIG. 17 shows an exemplary flow chart illustrating the operation of an exemplary digital radio broadcast receiver configured to render alert information in connection with a sleep mode.

FIG. 17 is a flow chart illustrating the exemplary operation of a digital radio broadcast receiver (e.g., an IBOC DAB receiver) configured to render alert information in connection with a sleep mode. The process starts at step 502, and at step 504 the digital radio broadcast receiver is maintained in a power condition in which a clock function is powered on and tuner functions and rendering functions are powered off (sleep mode). Signal processing functions, such as associated with reference numeral 241 in FIGS. 7 and 8, for example, may also be powered off in the sleep mode. In step 504, alert processor 297, with the assistance of the clock function determines whether a predetermined time has elapsed. If the predetermined amount of time has not elapsed, the process returns to the start 502, and a sleep mode is maintained until the predetermined amount of time has elapsed. Once the predetermined amount of time (e.g., 1 minute, 5 minutes, 10 minutes, 30 minutes, 1 hour) has elapsed, the process continues to step 506 where the tuner functions and some or all of the signal processing functions 241 are turned on. At step 508, the process continues by receiving a digital radio broadcast signal. At step 512, the alert processor 297 determines whether data corresponding to an alert message has been received, e.g., by checking whether the priority field of the data structure shown in FIG. 14 contains a "1", for example. If no data corresponding to the alert message is detected, the process reinitiates at the start 502. If data corresponding to an alert message is detected, the alert message comprising type information for identifying a type of the alert message and comprising message information, the alert processor 297 at step 516 determines whether the type information and optionally location information satisfy a triggering condition for a type of alert message (and a optionally a location setting) pre-selected by a user of the digital radio broadcast receiver (selected by the user as illustrated, for example, in FIGS. 15*a*-15*f*), such as described above with regard to FIG. 16. As discussed with regard to FIG. 16, the alert processor 297, can, for example, convert a received data structure such as shown in FIG. 14 back into a data structure such as shown in FIGS. 9*a*-9*c*, and can check the category type field and location fields for matches with selections for those quantities stored in memory at the receiver. If the triggering condition is not satisfied, the process returns to the start 502. If the triggering condition is satisfied, the rendering functions (and the remaining signal processing functions, if they were powered off in sleep mode) are powered on at step 518, and the message information is rendered at step 520. At step 522, after the message information is rendered, the process can return to the start 502 or can remain in a powered-on mode, which can be pre-selected by the manufacturer or can be user selectable.

As illustrated with respect to FIG. 17, the sleep mode functionality enables the digital radio broadcast receiver to "wake up" and render an alert message to a user even if the user is not currently listening to the radio in a powered on state. In sleep mode, the alert processor 297 performs the suitable processing and determines whether the alert message (and optionally location) is of a type previously selected by the user before powering on completely. As noted above, in some embodiments, signal processing functions 241 may be powered off along with the tuner functionality while in the sleep mode. Therefore, when the tuner functions are off, some or all of the signal processing functions 241 may also be powered off. For example, referring back to FIG. 7, signal processing functionality may be powered off along with the tuner function. When the tuner function powers on, the down converter 208, the demodulator 216, the deinterleaver 218, the Viterbi decoder 220, the service demultiplexer 222, the data processor 232, and the host controller 240 may also be powered on. It may not be necessary to power on the analog demodulator 212, the blender 228, or the processor 224. As would be understood by a person of ordinary skill in the art, suitable control functionality for "on" and "sleep" modes can be implemented in the controller 243 in FIGS. 7 and 8 under the influence of alert processor 297.

The methods described herein may be implemented utilizing either a software-programmable digital signal processor, or a programmable/hardwired logic device, firmware, or any other combination of hardware, software and firmware sufficient to carry out the described functionality. In addition, a computer readable medium may include instructions adapted to cause a processing system to carry out the methods described herein. The computer readable medium can be any suitable medium for storing such instructions, such as but not limited to a hard disk, floppy disk, compact disk (CD), digital versatile disk (DVD), magnetic tape, other magnetic or optical storage medium, random access memory (RAM), read only memory (ROM), flash memory, etc. Such instructions may also be embodied in modulated waves/signals (such as radio frequency, audio frequency, or optical frequency modulated waves/signals) that can be downloaded to a computer so as to cause a processing system to carry out the methods described herein.

While the present invention has been described in terms of its preferred embodiment, it will be understood by those skilled in the art that various modifications can be made to the disclosed embodiment without departing from the scope of the invention as set forth in the claims.

What is claimed is:

1. A method for rendering an alert message on a digital radio broadcast receiver, said method comprising:

controlling said digital radio broadcast receiver to maintain a power condition in which a clock function is powered on and in which tuner functions and rendering functions are powered off;

controlling said digital radio broadcast receiver to periodically power on said tuner functions to receive a digital radio broadcast signal;

receiving a digital radio broadcast signal at said digital radio broadcast receiver;

detecting data corresponding to an alert message within said digital radio broadcast signal, said data comprising message information and category type information of the detected alert message, wherein the category type information identifies a category of said message information conveyed by the alert message;

determining with a processing system whether said category type information of the detected alert message satisfies a triggering condition corresponding to a category type of alert message pre-selected by the user at a user interface of the digital radio broadcast receiver as a category of alert message that the user desires to receive;

if said triggering condition is satisfied, powering on said rendering functions of said digital radio broadcast receiver and rendering said message information of said alert message at said digital radio broadcast receiver; and if said triggering condition is not satisfied, powering off said tuner functions of said digital radio broadcast receiver.

2. The method of claim 1, wherein said alert message comprises information regarding time-sensitive commercial product availability or time-sensitive commercial service availability.

3. The method of claim 1, wherein said alert message comprises data corresponding to an emergency alert.

4. The method of claim 1, wherein said message information includes at least one of audio information and visual information to be rendered at said digital radio broadcast receiver.

5. The method of claim 1, comprising controlling an external device in response to the received alert message.

6. The method of claim 1, wherein said alert message comprises a primary alert information to be rendered by said digital radio broadcast receiver and secondary information that can be ignored if said digital radio broadcast receiver does not possess functionality to render said secondary information.

7. The method of claim 1, wherein the data corresponding to an alert message comprises location information, wherein the method comprises determining whether the location information satisfies the triggering condition.

8. A digital radio broadcast receiver for rendering an alert message, said digital radio broadcast receiver comprising:

a tuner;

a processing system; and a user interface comprising an input system for allowing said user to select which of multiple types of alert message are to be rendered, wherein said processing system is configured to:

maintain a power condition in which a clock is powered on and in which said tuner and said user interface are powered off;

periodically power on said tuner to receive said digital radio broadcast signal;

detect data corresponding to an alert message within said digital radio broadcast signal, said data comprising message information and category type information of the detected alert message, wherein the category type information identifies a category of said message information conveyed by the alert message;

determine whether said category type information of the detected alert message satisfies a triggering condition corresponding to a category type of alert message pre-selected by the user at a user interface of the digital radio broadcast receiver as a category of alert message that the user desires to receive; and if said triggering condition is satisfied, powering on said user interface of said digital radio broadcast receiver to cause said message information of said alert message to be rendered at said digital radio broadcast receiver;

if said triggering condition is not satisfied, powering off said tuner functions of said digital radio broadcast receiver.

9. The digital radio broadcast receiver of claim 8, wherein said alert message comprises information regarding time-sensitive commercial product availability or time-sensitive commercial service availability.

10. The method of claim 8, wherein said alert message comprises data corresponding to an emergency alert.

11. The digital radio broadcast receiver of claim 8, wherein said message information includes at least one of audio information or visual information to be rendered at said digital radio broadcast receiver.

12. The digital radio broadcast receiver of claim 8, wherein the processing system is configured to controlling an external device in response to the received alert message.

13. The digital radio broadcast receiver of claim 8, wherein said alert message comprises primary alert information to be rendered by said user interface of said digital radio broadcast receiver and secondary information that can be ignored if said user interface of said digital radio broadcast receiver does not possess functionality to render said secondary information.

14. The digital radio broadcast receiver of claim 8, wherein the data corresponding to an alert message comprises location information, wherein the processing system is configured to determine whether the location information satisfies the triggering condition.

15. An article of manufacture comprising a computer usable medium having computer readable program code embodied therein for rendering an alert message on a digital radio broadcast receiver, said computer readable program code adapted to cause a processing system of said digital radio broadcast receiver to:

control said digital radio broadcast receiver to maintain a power condition in which a clock function is powered on and in which tuner functions and rendering functions are powered off;

control said digital radio broadcast receiver to periodically power on said tuner functions to receive said digital radio broadcast signal;

detect data corresponding to an alert message within a digital radio broadcast signal, said data comprising message information and category type information of the detected alert message, wherein the category type information identifies a category of said message information conveyed by the alert message;

determine whether said category type information of the detected alert signal satisfies a triggering condition corresponding to a category type of alert message preselected by a user at a user interface of the digital radio broadcast receiver as a category of alert message that the user desires to receive;

if said triggering condition is satisfied, cause said message information of said alert message to be rendered at said digital radio broadcast receiver; and if said triggering condition is not satisfied, cause said tuner functions to power off.

16. The article of manufacture of claim 15, wherein said alert message comprises information regarding time-sensitive commercial product availability or time-sensitive commercial service availability.

17. The article of manufacture of claim 15, wherein said alert message comprises data corresponding to an emergency alert.

18. The article of manufacture of claim 15, wherein said message information includes at least one of audio information or visual information to be rendered at said digital radio broadcast receiver.

19. The article of manufacture of claim 15, wherein the computer readable program code is adapted to cause the processing system to control an external device in response to the received alert message.

20. The article of manufacture of claim 15, wherein said alert message comprises primary alert information to be rendered by said digital radio broadcast receiver and secondary information that can be ignored if said digital radio broadcast receiver does not possess functionality to render said secondary information.

21. The article of manufacture of claim 15, wherein the data corresponding to an alert message comprises location information, wherein the computer readable program code is adapted to cause the processing system to determine whether the location information satisfies the triggering condition.

22. The method of claim 7, wherein said determining whether the location information satisfies the triggering condition comprises determining whether the location information of the alert message corresponds to a geographic location designated by the user via the user interface of the digital radio broadcast receiver.

* * * * *